US006732801B2

(12) United States Patent
Ohmer et al.

(10) Patent No.: US 6,732,801 B2
(45) Date of Patent: May 11, 2004

(54) APPARATUS AND METHOD FOR COMPLETING A JUNCTION OF PLURAL WELLBORES

(75) Inventors: Herve Ohmer, Houston, TX (US); Dwayne D. Leismer, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/053,459

(22) Filed: Jan. 16, 2002

(65) Prior Publication Data

US 2002/0121375 A1 Sep. 5, 2002

Related U.S. Application Data

(63) Continuation-in-part of application No. 09/518,365, filed on Mar. 3, 2000, now Pat. No. 6,349,769, which is a continuation of application No. 08/898,700, filed on Jul. 24, 1997, now Pat. No. 6,056,059, which is a continuation-in-part of application No. 08/798,591, filed on Feb. 11, 1997, now Pat. No. 5,944,107.

(60) Provisional application No. 60/262,899, filed on Jan. 19, 2001, provisional application No. 60/025,033, filed on Aug. 27, 1996, provisional application No. 60/022,781, filed on Jul. 30, 1996, and provisional application No. 60/013,227, filed on Mar. 11, 1996.

(51) Int. Cl.[7] ..... E21B 7/06

(52) U.S. Cl. ..... 166/313; 166/50; 166/117.6

(58) Field of Search ..... 166/50, 313, 117.6

(56) References Cited

U.S. PATENT DOCUMENTS

| | | | | | |
|---|---|---|---|---|---|
| 1,900,163 | A | * | 3/1933 | Dana et al. | 175/9 |
| 2,492,079 | A | * | 12/1949 | Wiley | 166/117.5 |
| 4,396,075 | A | * | 8/1983 | Wood et al. | 175/79 |
| 4,415,205 | A | * | 11/1983 | Rehm et al. | 299/5 |
| 4,573,541 | A | * | 3/1986 | Josse et al. | 175/78 |
| 4,742,871 | A | * | 5/1988 | Miffre | 166/117.5 |
| 5,330,007 | A | | 7/1994 | Collins et al. | |
| 5,458,199 | A | | 10/1995 | Collins et al. | |
| 5,462,120 | A | | 10/1995 | Gondouin | |
| 5,477,925 | A | | 12/1995 | Trahan et al. | |
| 5,564,503 | A | | 10/1996 | Longbottom et al. | |
| 5,845,707 | A | | 12/1998 | Longbottom | |
| 5,941,308 | A | * | 8/1999 | Malone et al. | 166/313 |
| 5,944,107 | A | | 8/1999 | Ohmer | |
| 5,944,109 | A | | 8/1999 | Longbottom | |
| 5,960,873 | A | * | 10/1999 | Alexander et al. | 166/50 |
| 6,089,320 | A | | 7/2000 | LaGrange | |
| 6,158,513 | A | * | 12/2000 | Nistor et al. | 166/313 |
| 6,182,760 | B1 | * | 2/2001 | Phelps | 166/313 |
| 6,311,776 | B1 | | 11/2001 | Pringle et al. | |
| 6,336,507 | B1 | * | 1/2002 | Collins | 166/313 |

FOREIGN PATENT DOCUMENTS

GB 2 372 270 A 8/2002

OTHER PUBLICATIONS

Herve Ohmer, Jean–Marc Follini, Ricardo Carossino, Mirush Kaja; "Well Construction and Completion Aspects of A Level 6 Multilateral Junction"; SPE 63116, pp. 1–8.

* cited by examiner

*Primary Examiner*—Hoang Dang
(74) *Attorney, Agent, or Firm*—Trop, Pruner & Hu PC; Jeffrey Griffin; Brigitte Jeffery Echols

(57) ABSTRACT

A method and apparatus for completing a junction of plural wellbores includes providing a casing junction assembly having plural outlets for communicating with corresponding wellbores. A tool has plural extendable conduits for engaging in the outlets. The casing junction assembly has an integral diverter with guiding surfaces to guide the conduits into the outlets.

31 Claims, 23 Drawing Sheets

APPARATUS AND METHOD FOR COMPLETING A JUNCTION OF PLURAL WELLBORES

CROSS REFERENCE TO RELATED APPLICATIONS

This claims the benefit under 35 U.S.C. § 119(e) to U.S. Provisional Application Serial No. 60/262,899, filed Jan. 19, 2001. This is also a continuation-in-part of Ser. No. 09,518,365 now U.S. Pat. No. 6,349,769 filed Mar. 3, 2000, which is a continuation of Ser. No. 08/898,700 now U.S. Pat. No. 6,056,059 filed Jul. 24, 1997, which is a continuation-in-part of Ser. No. 08/798,591 filed Feb. 11, 1997 now U.S. Pat. No. 5,944,107, which claims priority under 35 U.S.C. § 119(e) to U.S. Provisional Application Nos. 60/013,227, filed Mar. 11, 1996, 60/025,033, filed Aug. 27, 1996, and 60/022,781, filed Jul. 30, 1996, all hereby incorporated by reference.

TECHNICAL FIELD

This invention relates generally to subsurface tools used in the completion of subterranean wells and, more particularly, provides an apparatus and method for use in multilateral completions.

BACKGROUND

Hydrocarbon fluids such as oil and natural gas are obtained from a subterranean geologic formation, such as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, the production of oil and gas can begin.

It is increasingly commonplace within the industry to drill and complete multilateral wells. These are wells that contain one or more lateral wellbores that extend out from a main wellbore running to the earth's surface. These lateral wellbores can increase the production capacity and ultimate recovery from a single productive formation, or may allow multiple reservoirs to be depleted from a single well. This is particularly true when drilling from an offshore platform where multiple wells must be drilled to cover the great expenses of offshore drilling.

Standard completion practices are to complete the lateral wellbores separately. This requires separate trips into the well to perform the completion operations, with each trip resulting in significant costs of money and time.

There is a need for apparatus and methods to reduce the time and expense of completing multilateral wells.

SUMMARY OF THE INVENTION

In general, according to an embodiment, a downhole assembly comprises a casing junction assembly adapted to be installed at a junction of plural wellbores, the casing junction assembly defining plural outlets to respective plural lateral wellbores, and the casing junction assembly having an integrated diverter providing plural guide surfaces proximate corresponding outlets.

A method of completing a well at a junction of plural wellbores comprises providing a casing junction assembly having plural outlets for establishing communication with respective plural wellbores, and providing a diverter integrated with the casing assembly, with the diverter having plural guide surfaces. A tool having plural conduits is engaged with the casing junction assembly, and the conduits are guided into respective outlets with the plural guide surfaces.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
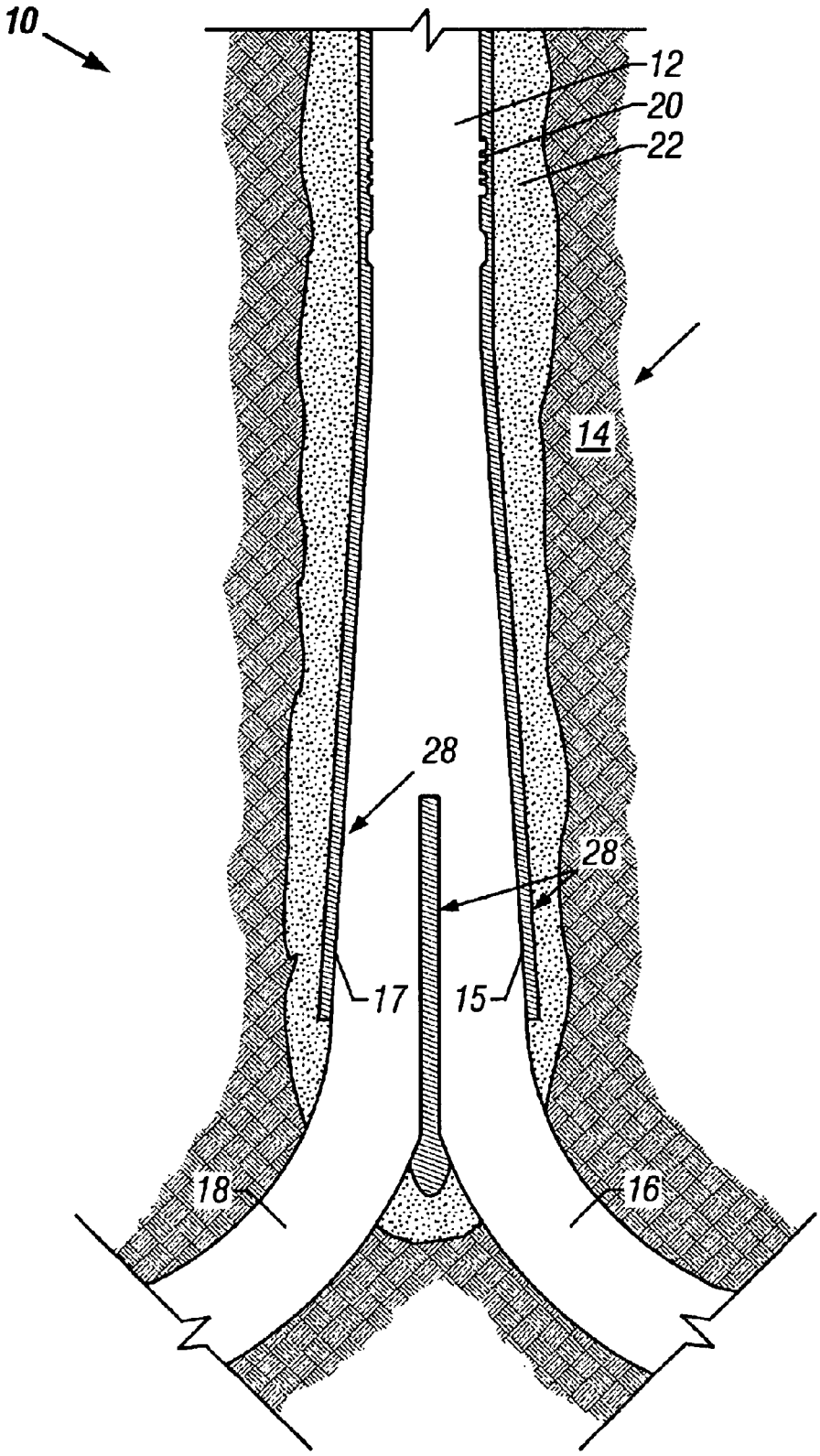
FIG. 1 is a schematic of an example embodiment of a casing assembly installed in a multilateral well.

Referring to FIG. 1, a multilateral well, shown generally as 10, includes a main wellbore 12 that is drilled into a subterranean zone 14. The main wellbore 12 is stabilized by inserting a string of casing 20 that is cemented 22 in place. The casing 20 may include a casing junction assembly 28, which may be cemented in place concurrently with the remainder of the casing 20. A first lateral wellbore 16 and a second lateral wellbore 18 are shown that have been drilled from the main wellbore 12 and from the casing junction 28 assembly. The lateral wellbores may have smaller diameters than the main wellbore. However, that is not necessarily the case in other embodiments. The casing junction assembly 28 thus completes a junction of plural wellbores. As used here, the term "wellbore" or "bore" refers to either a main wellbore or a lateral wellbore.

Figure 2:
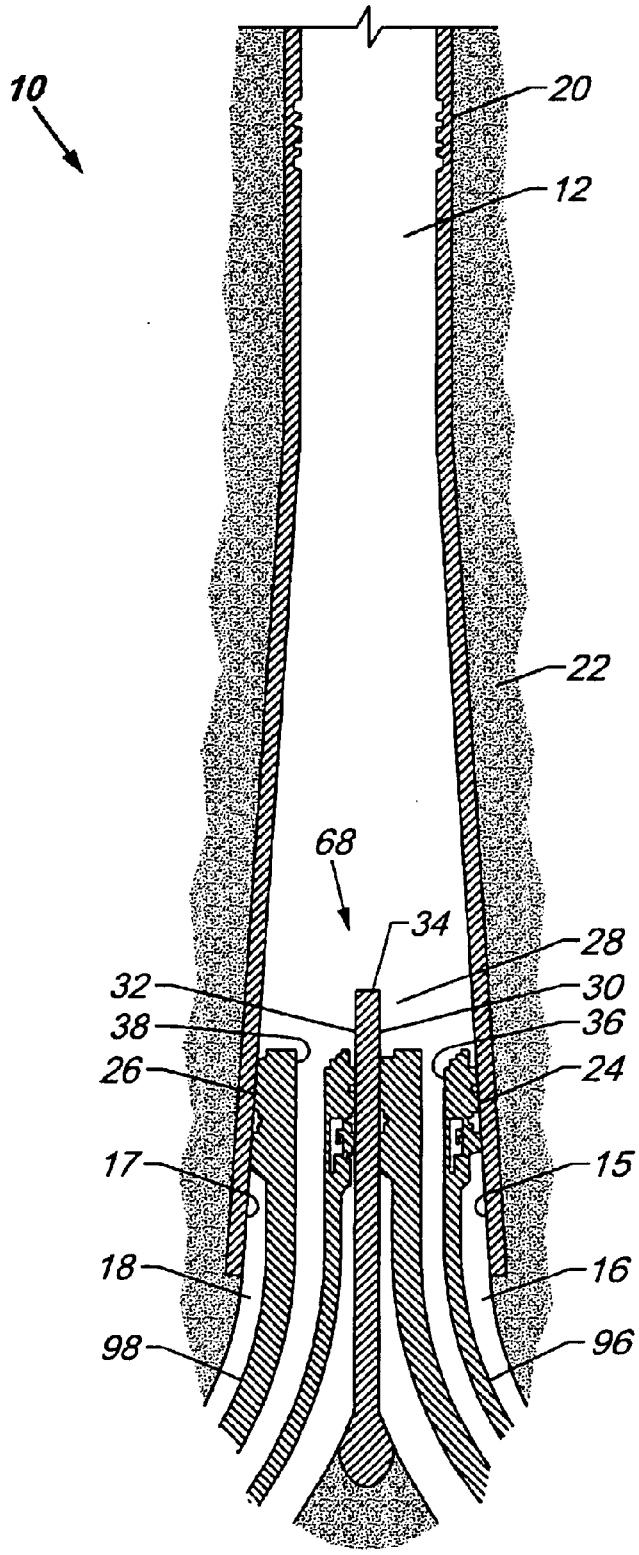
FIGS. 2–4 show further completion of the multilateral well of FIG. 1.

FIG. 2 shows a multilateral well 10 having a casing junction assembly 28 set within the main wellbore 12 and other junction equipment installed in the casing junction assembly 28. The casing junction assembly 28 provides the connection of the main wellbore 12 and the lateral wellbores 16, 18. The casing junction assembly 28 is attached to the remainder of the casing 20 and run into the well and cemented with the remainder of the casing 20 (cement layer shown at 22). The casing junction 28 can be run into the well in a collapsed configuration and expanded to its final configuration prior to being cemented in place, as described in U.S. Pat. No. 6,283,216, which application is incorporated herein by reference.

The lateral wellbores 16 and 18 are drilled after the casing 20 and the casing junction 28 are cemented in place. Once a lateral wellbore is drilled, a liner 96, 98 can be run into the lateral wellbore 16, 18 and set in place with a packer type device, also known as a liner hanger. Packers 24, 26 attached to liners 96, 98 are shown located within the first and second branch legs 15, 17 of the casing junction assembly 28. In alternative embodiments, the packers 24, 26 can be set directly within the first and second lateral wellbores 16, 18. The first and second legs 15, 17 are aligned to communicate with the first and second lateral wellbores 16, 18.

The casing junction assembly 28 includes a first guide surface 30 that serves to deflect items towards the first leg 15 and the first lateral wellbore 16, and a second guide surface 32 that serves to deflect items towards the second leg 17 and the second lateral wellbore 18. The casing junction assembly 28 shown also includes a projection 34 that extends upwardly. The first guide surface 30, second guide surface 32, and projection 34 are part of a diverter 68. Since the casing junction assembly 28 can be symmetrical in shape and includes the diverter 68, a separate tool, such as a typical whipstock, is not needed to deflect a tubing string into each of the legs and lateral wellbores. The packers 24, 26 include polished bore receptacles 36, 38 and are located above the zones to be produced.

The diverter 68 is an "integrated" diverter; that is, it is part of the casing junction assembly 28, as contrasted with a diverter that is run in separately for engagement with the casing junction assembly 28. The diverter 68 can either be integrally formed with the casing junction assembly 28, or the diverter 68 can be affixed permanently to the casing junction assembly 28 by an attachment mechanism. The diverter is integrated in the sense that it is part of the casing junction assembly 28 when the casing junction assembly 28 is installed at the junction to be completed.

Figure 3:
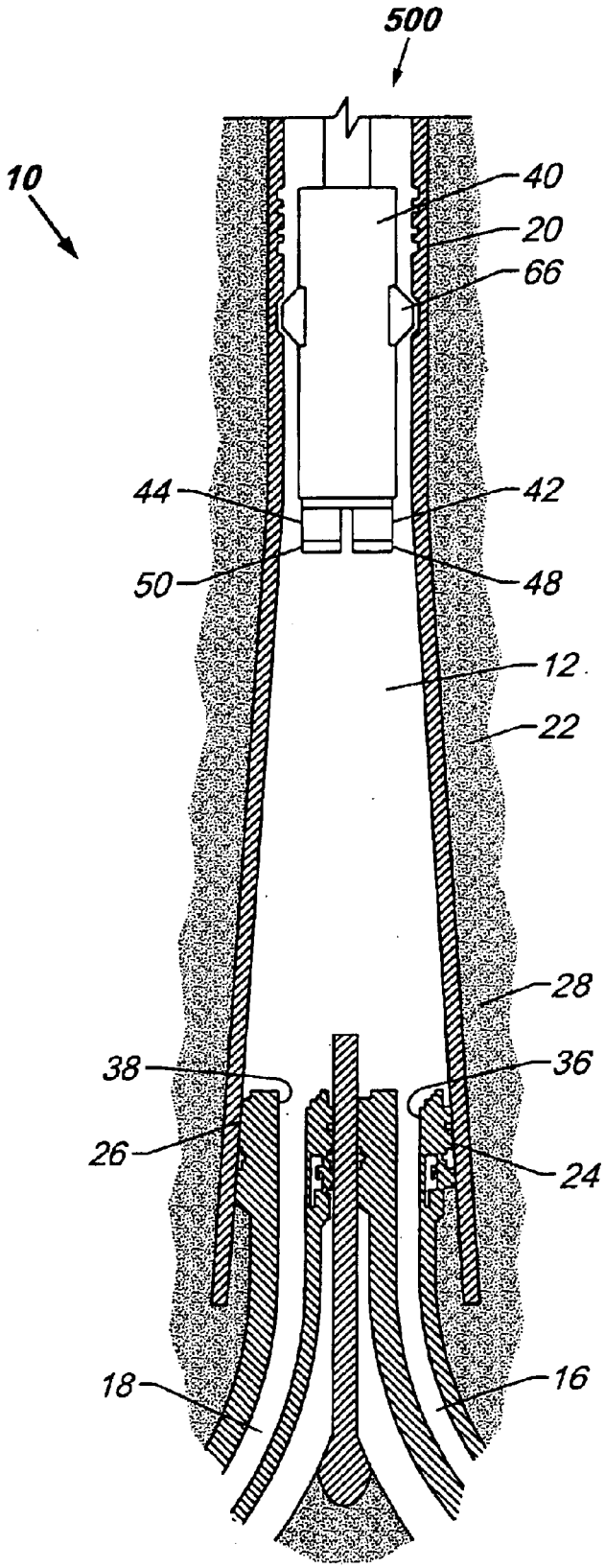

Referring to FIG. 3, an embodiment of the invention where a landing tool 40 is placed within the main wellbore 12 is shown. After the casing 20 and the casing junction assembly 28 have been cemented in place, the lateral wellbores 16, 18 are drilled and the first and second packers 24, 26 are set in place within the first and second legs 15, 17, respectively. An assembly including a landing tool 40, a first tubing string 42, and a second tubing string 44 may be connected to a deployment string 500 and inserted into the main wellbore 12. The first tubing string 42 includes a seal assembly 48, extends from the landing tool 40, and is generally aligned with the first leg 15 and first lateral wellbore 16. The second tubing string 44 includes a seal assembly 50, extends from the landing tool 40, and is generally aligned with the second leg 17 and the second lateral wellbore 18. The landing tool 40 is lowered into the well casing 20 and is aligned with respect to the lateral wellbores in a manner discussed below. Once the landing tool 40 is set and locked in place, a weight may be placed down on the deployment string 500 to simultaneously extend the tubing strings 42, 44 out from the landing tool 40 to enter the first and second legs 15, 17 and engage in the polished bore receptacles 36, 38 of respective packers 24, 26.

Although the Figures show that the landing tool 40 is set and locked in place within the casing junction assembly 28, the landing tool 40 may be set and locked in place in the casing 20 above the casing junction assembly 28 in other embodiments.

In one embodiment, the deployment string 500 can then be disconnected from the landing tool 40 and removed to the earth's surface. In this embodiment, the remaining completion equipment is deployed in another downhole trip, resulting in two trips being performed to complete the well. In an alternative embodiment, the deployment string 500 comprises permanent completion tubings and/or components that remain downhole after the extension of the tubing strings 42, 44. Thus, in this alternative embodiment, only one trip is required to complete the well.

The landing tool 40 is fixed in place by a setting element 66 that restricts any longitudinal or rotational movement of the landing tool 40. The setting element 66 includes slips that extend out to engage the inner wall of the casing junction assembly 28 (see FIG. 5) or casing 20. Other forms of the setting element 66, such as locking elements/dogs 200 (see FIGS. 16–22), can be used in other embodiments. The setting element 66 (or locking elements/dogs 200) are examples of landing elements engageable with landing profiles at the junction.

Once the landing tool 40 is correctly oriented in relation to the lateral wellbores 16, 18, the landing tool 40 is then locked in position by the setting element 66. The setting element 66 is engaged by exerting a downward force onto the tool that breaks a shear element and extends slips to engage with the casing junction 28 or casing 20.

Figure 4:
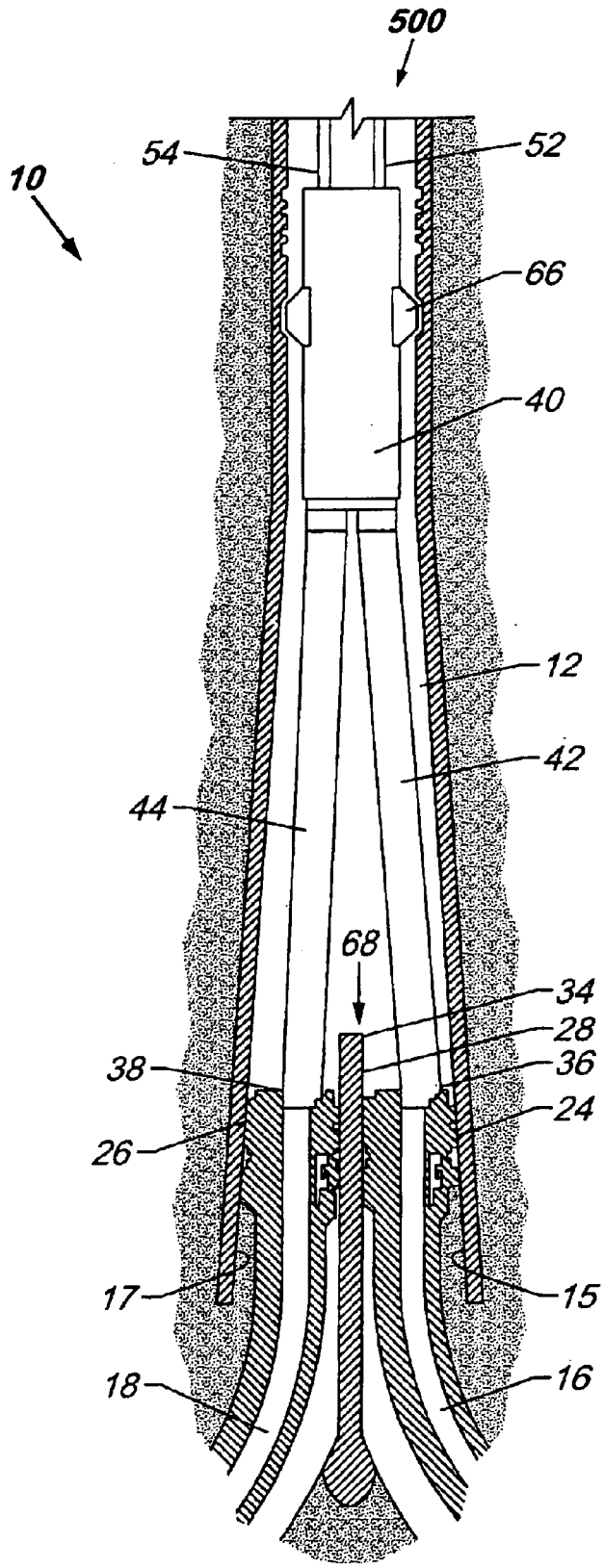

After the tool is locked in place by the setting element 66, a further downward force can be exerted onto the tool that will break yet another shear element and will enable the extension of the tubing strings, as shown in FIG. 4. As the tubing strings 42, 44 extend from the landing tool 40, the diverter 68 deflects each of the tubing strings 42, 44 into its respective casing junction leg 15, 17. Specifically, as the first tubing string 40 extends from the landing tool 40, it contacts first guide surface 30. First guide surface 30 then serves to guide the first tubing string 40 towards the first leg 15. Concurrently, as the second tubing string 42 extends from the landing tool 40, it contacts second guide surface 32. Second guide surface 32 then serves to guide the second tubing string 42 towards the second leg 17. The first tubing string 42 and the second tubing string 44 proceed until they seat in their respective polished bore receptacles 36, 38. The diverter 68 is located between the two tubing strings 42, 44, thus preventing them from both going into a single leg or lateral wellbore. It is noted that the tubing strings 42, 44 can be connected in some way, such as by a pin or strap that can be broken as the tubing strings are deflected away from each other by the diverter 68.

Figure 23:
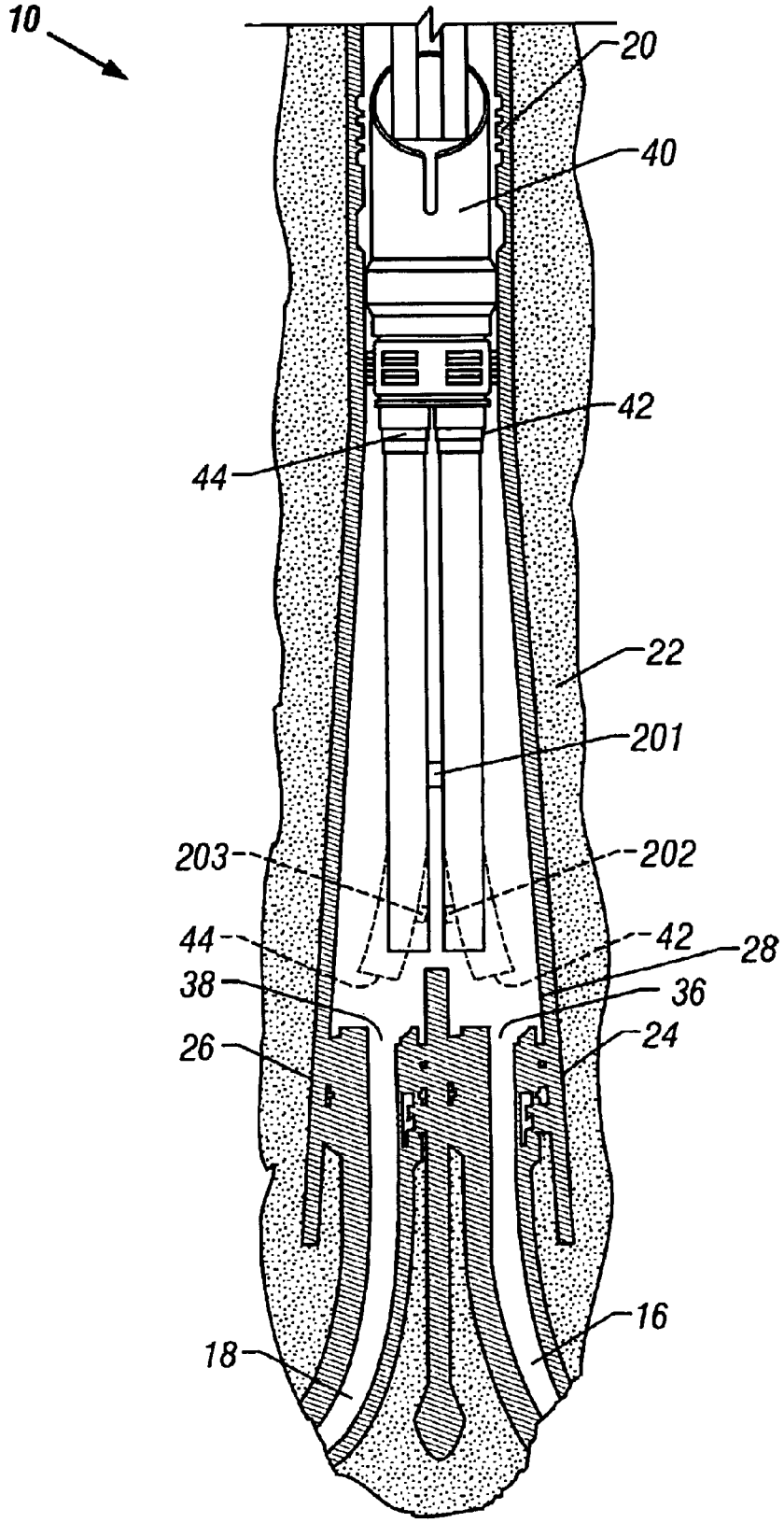
FIG. 23 shows an alternate embodiment of the present invention.

As shown in FIG. 23, the tubing strings 42, 44 can be constructed in a manner so as to be biased away from each other when not connected. The tubing strings 42, 44 can be connected, such as by a pin or strap 201. In this way, when the connection 201 is broken as shown by the dashed lines in FIG. 23, the tubing strings 42, 44 naturally deflect from each other based on the bias to facilitate the separation and insertion of the tubing strings into the legs 15, 17. The connection 201 can be broken into parts 202, 203, such as by the separation induced by the diverter 68. In this embodiment, the diverter 68 cooperates with the biasing of the tubing strings 42, 44 to induce deflection of the tubing strings into the lateral wellbores 16, 18.

In the embodiment shown in FIG. 4, the deployment string 500 is removed and dual production tubing strings 52, 54 are run into the main wellbore 12 and attached to the landing tool 40 so as to establish fluid communication with the first and second tubing strings 42, 44, respectively. In an alternative embodiment, the deployment string 500 includes the dual production tubing strings 52, 54 and so the landing tool 40 is run downhole together with the dual production tubing strings 52, 54.

In the discussion above, the landing tool 40 is described as being capable of orienting the string, setting the string within the casing, and also extending the tubing strings. These different operations can be separated from each other and performed by two or more separate tools. For example, a completion assembly may include three separate tools: one tool used for orienting the completion assembly, a second tool used to set the completion assembly within the casing to prevent any longitudinal or rotational movement, and a third tool used to extend the tubing strings through the junction and into their respective lateral wellbore. This description is not meant to limit the manner in which these operations can be performed.

Figure 5:
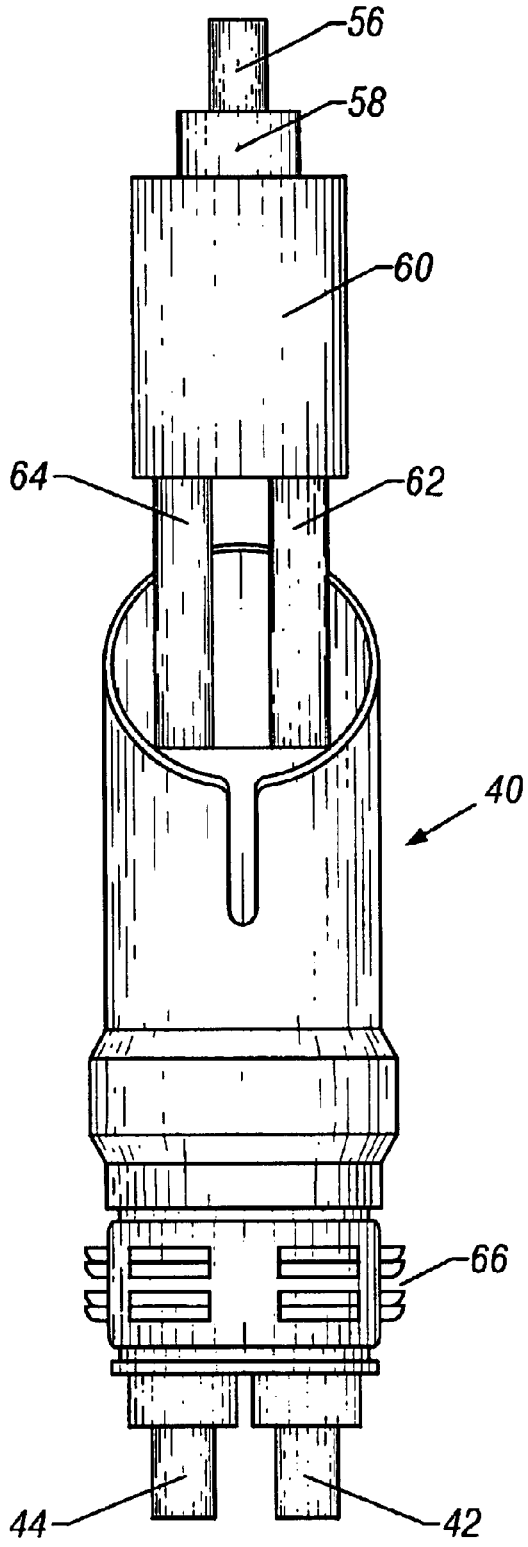
FIG. 5 shows an alternate embodiment of the invention.

FIG. 5 illustrates an alternate embodiment where a single production tubing string 56 is used, instead of the dual tubings 52, 54 as shown in FIG. 4. In one embodiment, a swivel 58 is connected between the tubing 56 and a wireline reentry tool 60, which has two relatively short sections of production tubing or "tubing subs" 62, 64 for engagement with the landing tool 40 and the tubing strings 42, 44. In this embodiment, the wireline reentry tool 60 is deployed after the retrieval of the deployment string 500. In another embodiment, the deployment string 500 includes a Y-block mechanism connected at its bottom to the dual production tubing strings 52, 54 and at its top to the single production tubing string 56. In this embodiment, the deployment string 500 is not retrieved after the landing tool 40 is set.

If it is desired pull the landing tool 40 and tubing strings 42, 44 out of the well 10, the tubing strings 42, 44 can be withdrawn from the packers 24, 26 and pulled back into their pre-extended configuration. An upward force can then be exerted on the landing tool 40 by pulling on the deployment string 500 until yet another shear element is broken, which causes the setting element 66 to retract and release the landing tool 40 to be pulled out of the well 10.

Figure 6:
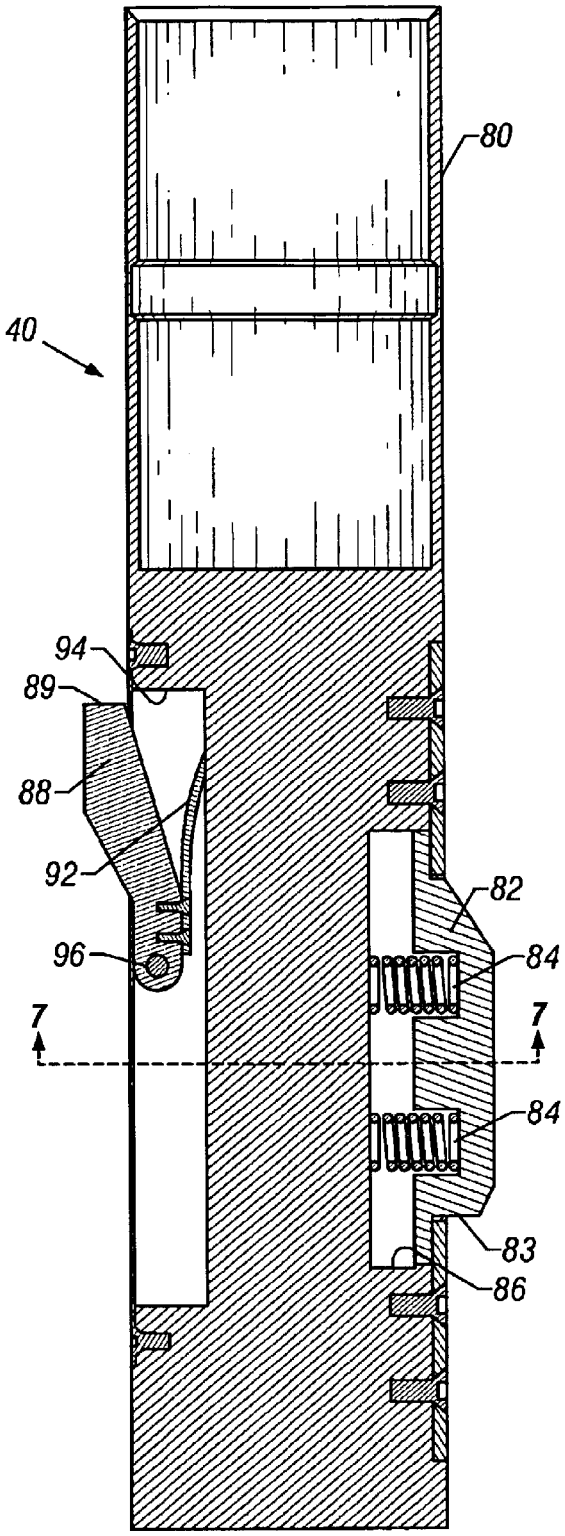
FIGS. 6–10 show longitudinal and cross section illustrations of various embodiments of the present invention.
Figure 7:
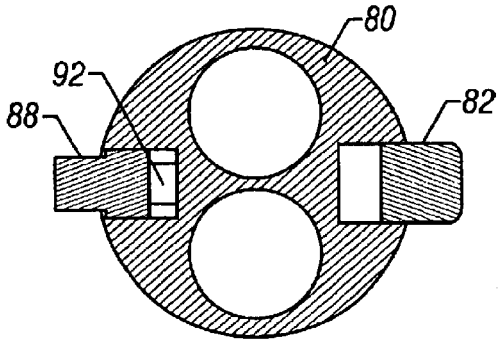

Referring to FIGS. 6 and 7, the landing tool 40 according to one embodiment includes a body 80 and an orienting key 82 that is biased outwardly, for example, by one or more springs 84. The orienting key 82 is disposed within a first recess 86 in the body 80. The orienting key 82 is capable of radial movement within the first recess 86. A locking key 88 is movably secured to the body 80, and is biased outwardly, for example by a leaf spring 92, which may be secured to the locking key 88. The locking key 88 can be disposed within a second recess 94 in the body 80 and is coupled to the body 80 by a hinge pin 96, for example.

Figure 8:
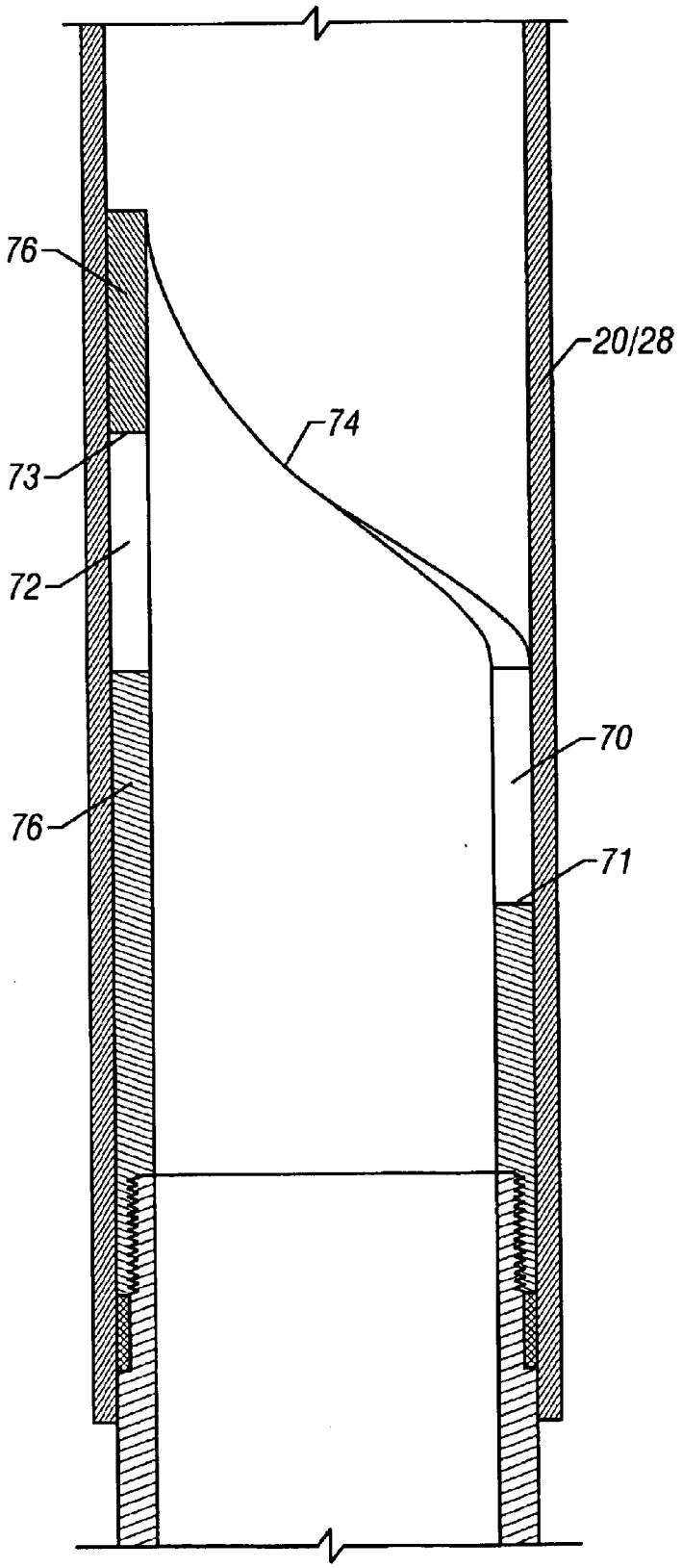

FIG. 8 shows an illustration of the casing 20 or casing junction assembly 28 (recall that the landing tool 40 may be set either in the casing junction assembly 28 or in the casing 20 above the casing junction assembly 28) in a particular embodiment of the apparatus. The casing 20 or casing junction assembly 28 includes an orienting slot 70, a locking slot 72 and an orienting profile 74 that can be used in conjunction with the landing tool 40 (FIGS. 6 and 7). The profile 74, orienting slot 70 and locking slot 72 may be formed as part of the well casing 20 or casing junction 28, or as a separate component (sometimes called a "muleshoe" or a "discriminator" 76), that is attached to the casing 20/casing junction assembly 28.

Figure 9:
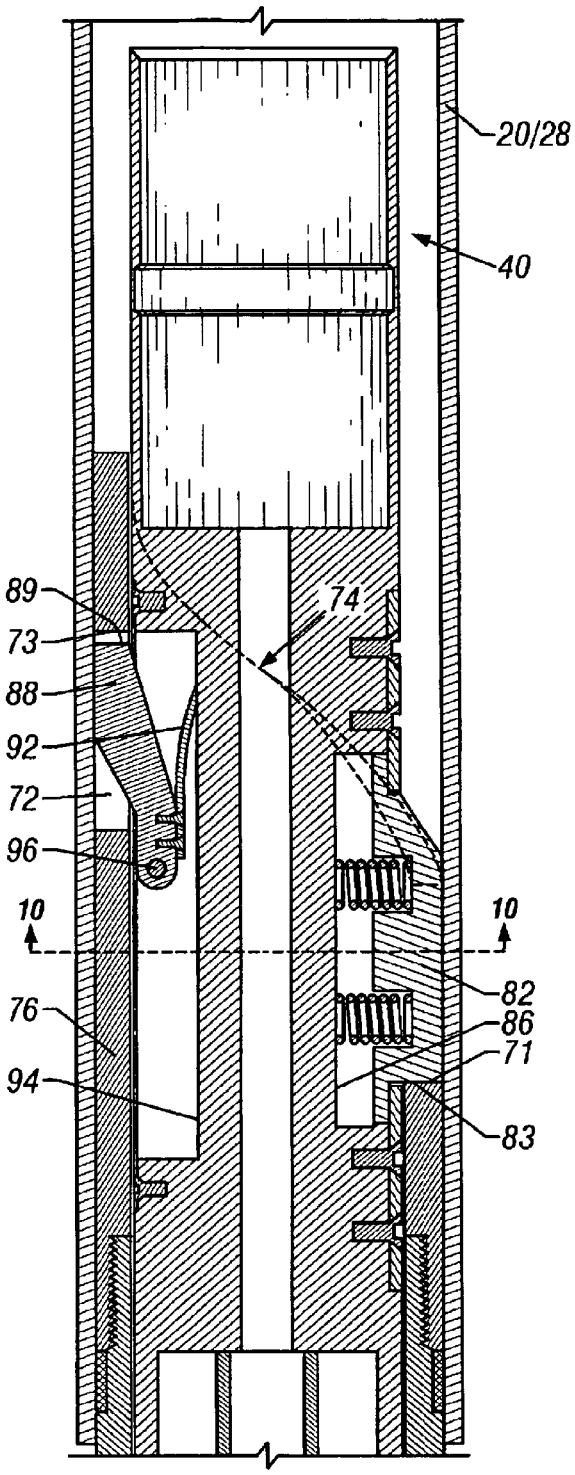
Figure 10:
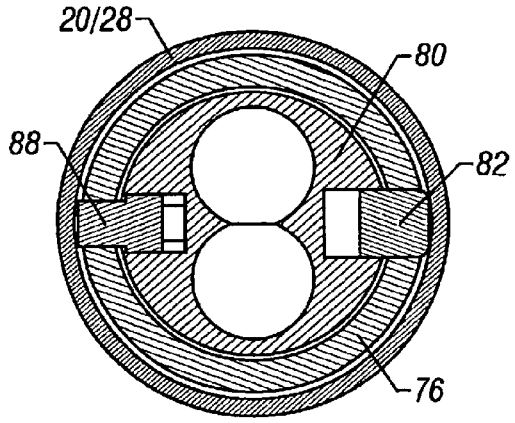

FIGS. 9 and 10 illustrate the landing tool 40 engaged within the well casing 20/casing junction assembly 28. As the landing tool 40 is inserted into the well casing 20/casing junction assembly 28, a lower edge 83 of the orienting key 82 (FIG. 6) contacts the profile 74 (FIG. 8). Continued downward movement of the landing tool 40 causes the orienting key 82 to move along the profile 74 and into engagement with the orienting slot 70, thereby rotating the landing tool 40, and any attached items, into alignment with the diverter 28 and the first and second lateral wellbores 16, 18 (FIGS. 3 and 4). The lower edge 83 of the orienting key contacts a lower ledge 71 of the orienting slot 70, which restricts any further downward movement. As the orienting key 82 moves into the orienting slot 70, the locking key 88 is longitudinally and radially aligned with the locking slot 72. As the lower edge 83 of the orienting key bottoms out on the lower ledge 71 of the orienting slot 70, the locking key 88 will be moved into the locking slot 72 under force from the locking key spring 92. Any upward movement is then prevented by contact of the upper edge 89 of the locking key 88 with the upper edge 73 of the locking slot 72.

Figure 11:
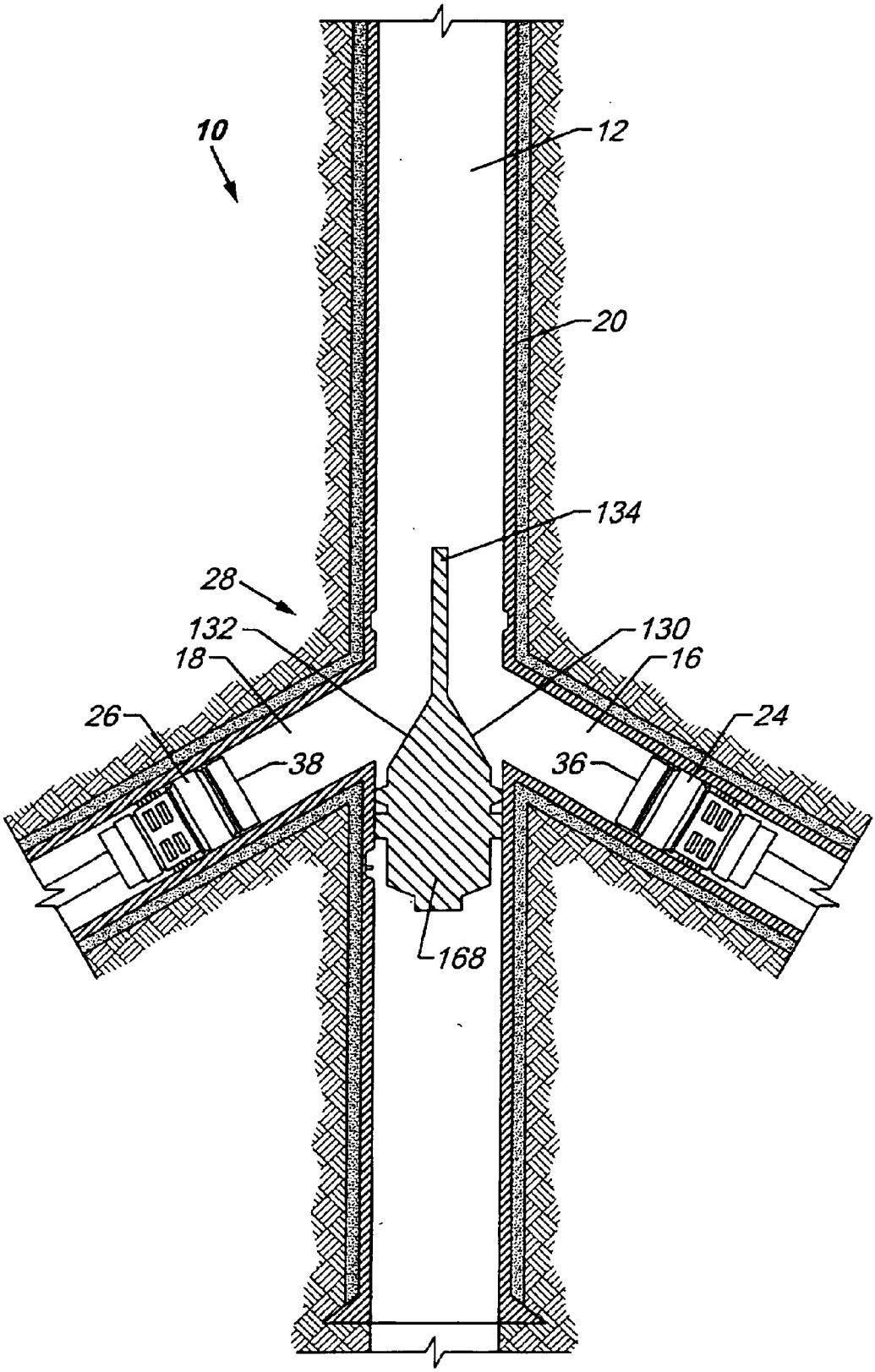
FIGS. 11–13 show alternate embodiments of the present invention within a multilateral well.

FIG. 11 shows a multilateral well 10 having packers 24, 26 located within the first and second lateral wellbores 16, 18. A diverter 168, which is a part of the casing junction assembly 28, is shown set within the main wellbore 12 proximal the junction of the main wellbore 12 and the lateral wellbores 16, 18. The diverter 168 can be positioned within the well in numerous ways. For example, the diverter 168 can be retrievably set in a manner such as a packer, the diverter 168 can be cemented in place, or the diverter 168 can be included as an integral part of the casing 20. The diverter 168 has a first guide surface 130 that serves to deflect items towards the first lateral wellbore 16, and a second guide surface 132 that serves to deflect items towards the second lateral wellbore 18. The diverter 168 shown also includes a projection 134 that extends upwardly from the diverter 168. The packers 24, 26 include polished bore receptacles 36, 38 and are located above the zones to be produced.

Figure 12:
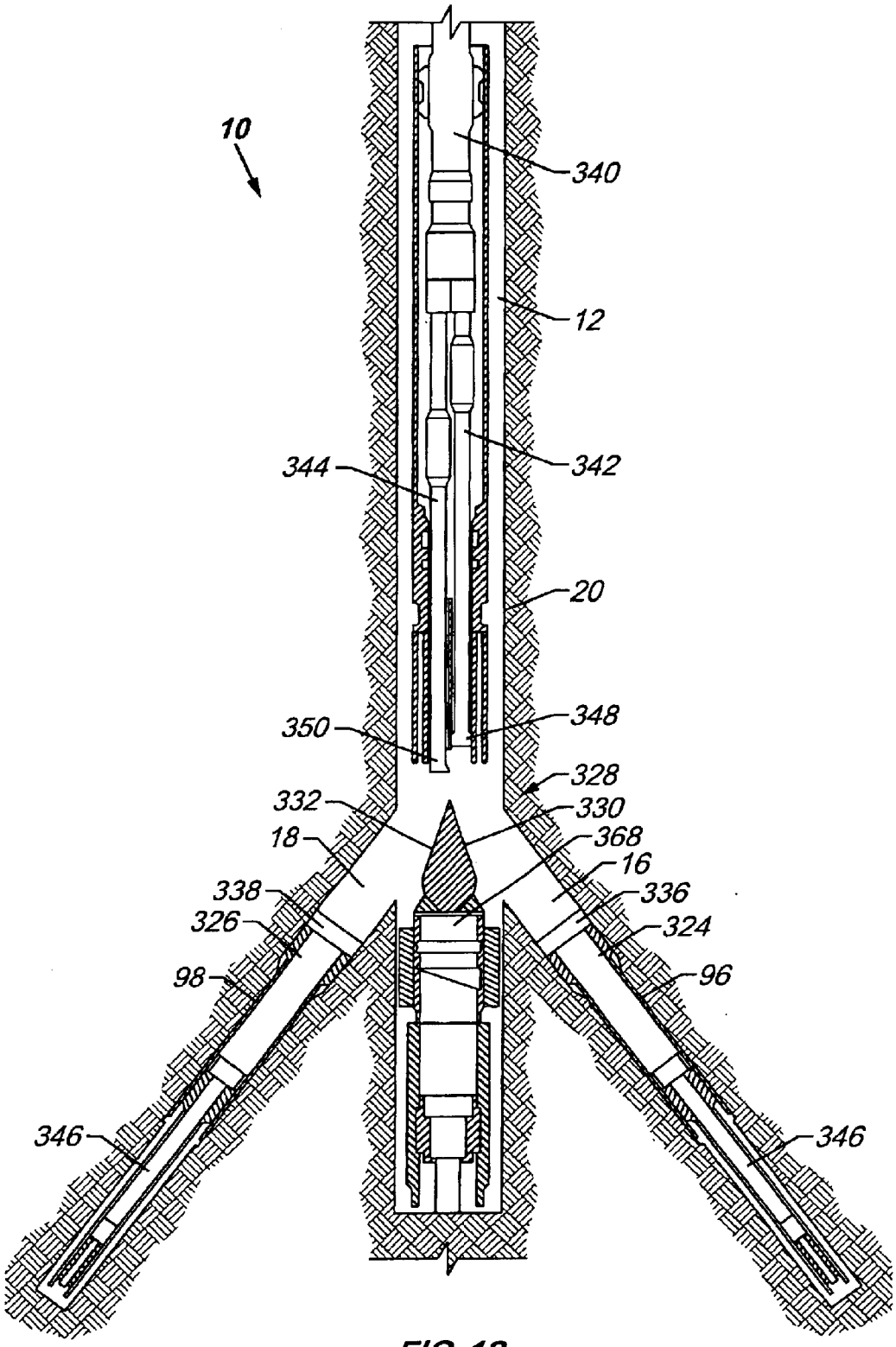

Referring to FIG. 12, another embodiment of a casing junction assembly 328 is shown. After the casing 20 has been cemented in place, first and second packers 324, 326 are set in place within the lateral wellbores 16, 18, respectively. An assembly including a landing tool 340, a first tubing string 342 and a second tubing string 344 is connected to a deployment string (not shown) and inserted into the main wellbore 12. The first tubing string 342 includes a seal assembly 348, extends from the landing tool 340, and is aligned with the first guide surface 330 of a diverter 368. The second tubing string 344 includes a seal assembly 350, extends from the landing tool 340, and is aligned with the second guide surface 332. The first lateral wellbore 16 contains a first packer 324 having a receptacle 336 and a sand screen assembly 346. The second lateral wellbore 18 contains a second packer 326 having a receptacle 338 and a sand screen assembly 348. The landing tool 340 is lowered into the well casing 20 and is aligned with respect to the lateral wellbores. Once the landing tool 340 is set in place, a weight may be placed down on the deployment string (not shown) to simultaneously extend the tubing strings 342, 344 out from the landing tool 340 to contact the diverter 368. The extended tubing strings enter the lateral wellbores 16, 18 and engage with their respective packers 324, 326. The deployment string (not shown) can then be disconnected from the landing tool 340 and removed to the earth's surface.

Figure 13:
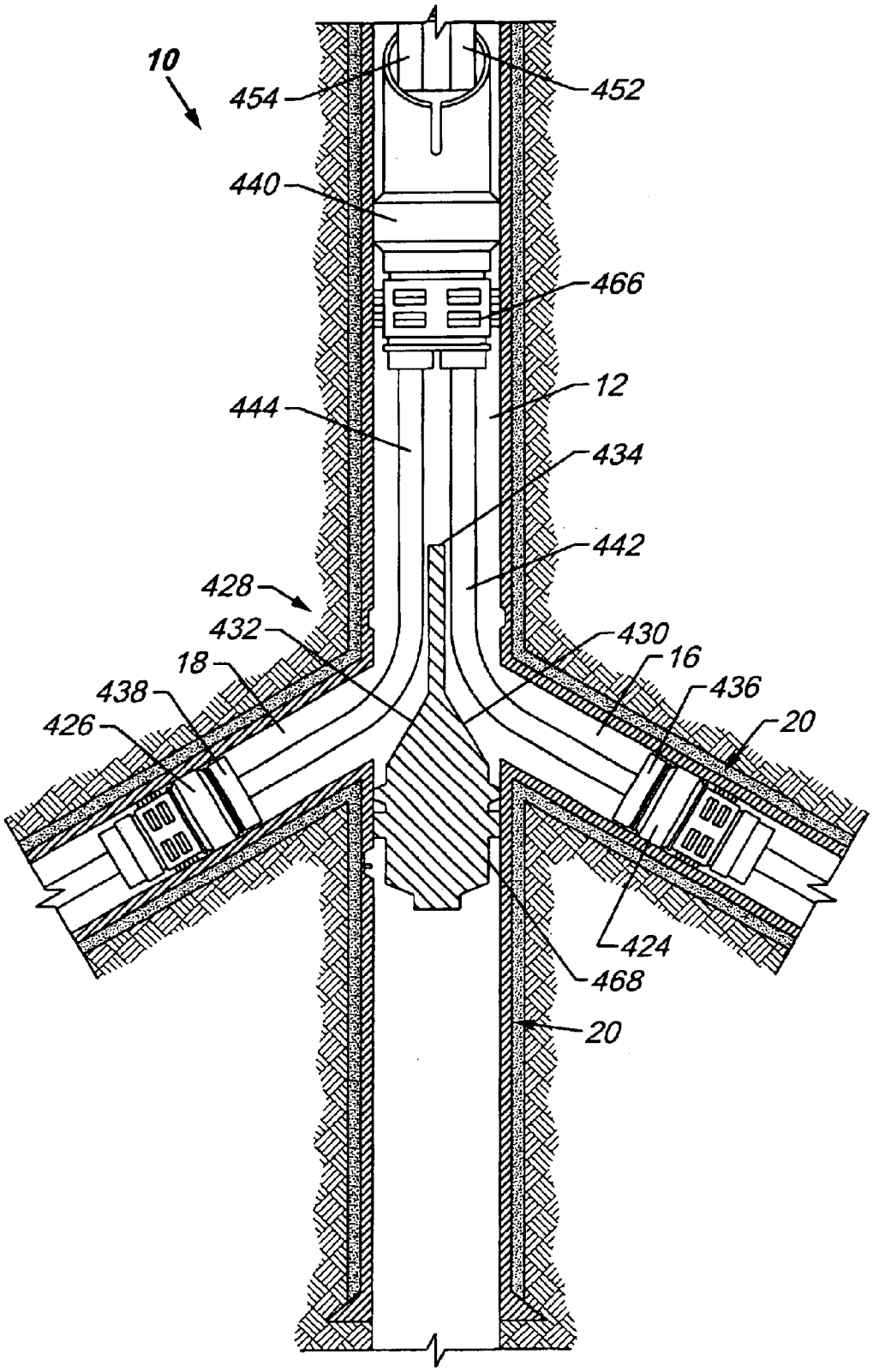

FIG. 13 shows yet another embodiment of a casing junction assembly 428. A landing tool 440 is fixed in place by a setting element 466 that restricts any longitudinal or rotational movement of the landing tool 440. A first tubing string 442 and second tubing string 444 extend from the landing tool 440. The first tubing string 442 is separated from the second tubing string 444 by the projection 434 of a diverter 468. The first tubing string 442 is deflected by the first guide surface 430 into the first lateral wellbore 16 where it seats in the receptacle 436 of a first packer 424. The second tubing string 444 is deflected by a second guide surface 432 into the second lateral wellbore 18 until it seats in a receptacle 438 of a second packer 426.

Phrases such as "separation of tubing strings by a diverter projection" are meant to mean that the diverter projection is located between the two tubing strings thus restricting them from both going into a single lateral wellbore and aligning them in respect to the applicable guide surface. The phrase is not meant to imply a physical attachment between them that is being broken, although that is possible. In the embodiment of FIG. 13, the deployment string (not shown) has been removed and dual production tubings 452, 454 have been run into the main wellbore 12 and attached to the landing tool 440, so as to establish fluid communication with the first and second tubing strings 442, 444, respectively.

Figure 14:
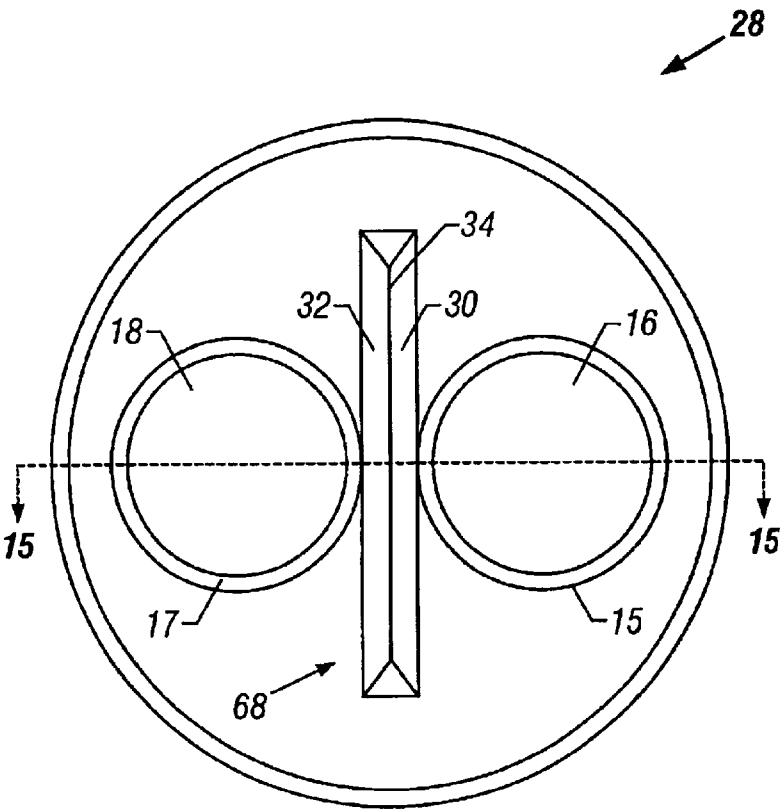

FIG. 14 is an overhead view of an embodiment of the casing junction assembly 28. The two legs 15, 17 that form the starting point of lateral wellbores 16 and 18 are shown as cylindrical tubes. The projection 34 having guide surfaces 30, 32 is located between the two legs 15, 17.

Figure 15:
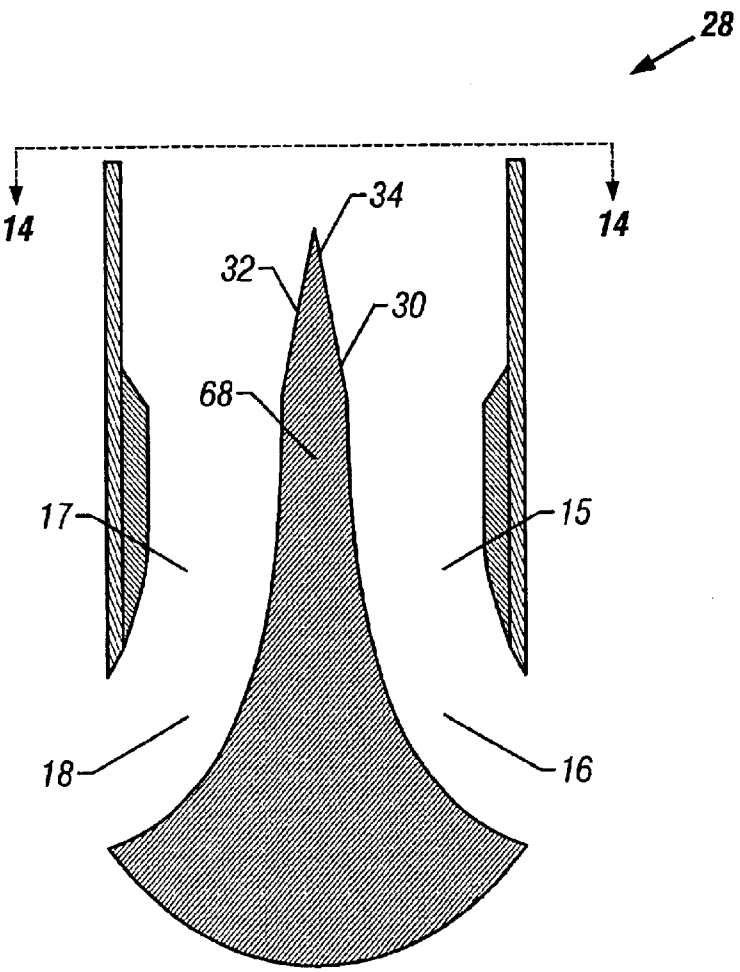
FIGS. 14–15 show section views of an embodiment of the casing junction.

FIG. 15 is a longitudinal sectional side view of the casing junction assembly of FIG. 14. The legs 15, 17 can be seen to project outward to provide communication to the lateral wellbores 16 and 18. The projection 34 is shown to extend above the openings of the lateral legs 15, 17. The diverter 68 portion of this embodiment is shown to be between the two legs 15, 17. The guide surfaces 30, 32 are shown sloping towards the respective lateral wellbore.

FIGS. 16–22 illustrate one embodiment of the landing tool 40 in greater detail. Similar to the landing tool 40 depicted in FIGS. 6 and 7, the landing tool 40 of this embodiment includes a body 80' (FIG. 16B) and at least one orienting key 82' that is biased outwardly, for example, by one or more leaf springs 84'. The orienting key 82' is disposed within a first recess 86' in the body 80'. The orienting key 82' is held within the first recess 86' by at least one retainer 301 and is capable of radial movement within the first recess 86'. The orienting mechanism of this embodiment functions in the same manner as the orienting mechanism of the landing tool 40 embodiment depicted in FIGS. 6–9.

The landing tool 40 of FIGS. 16–22 further includes at least one locking element 200 (similar to setting element 66 of FIGS. 3 and 4) movably secured to the body 80'. The body 80' can include a plurality of locking elements 200, each element 200 biased outwardly by one or more springs 202 and held within corresponding one or more second recesses 204 by at least one retainer 303

The body 80' may include a first body part 206 and a second body part 208 that may slide in relation to each other. In one embodiment, the orienting key 82' is located on the first body part 206, and the locking elements 200 are located on the second body part 208. First body part 206 includes at least one protruding element 210, such as at least one finger, extending from its bottom portion. Protruding element 210 may also be a sleeve in other embodiments. The fingers 210 may or may not be integral with the remainder of the first body part 206. Each finger 210 is housed and can slide in a slot 212 formed on the second body part 208. Each second recess 204 is part of a slot 212. The fingers 210, the slots 212, the locking elements 200, and the second recess 204 are constructed so that each finger 210 can slide into a second recess 204 and next to a locking element 200, thereby preventing further radial movement of such locking element 200.

Figure 20A:
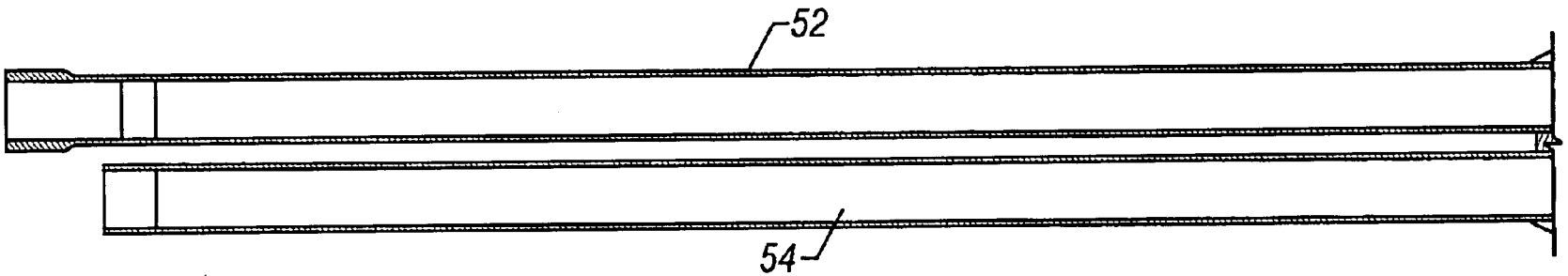
FIGS. 16–22 show an alternate embodiment of a landing tool.
Figure 20B:
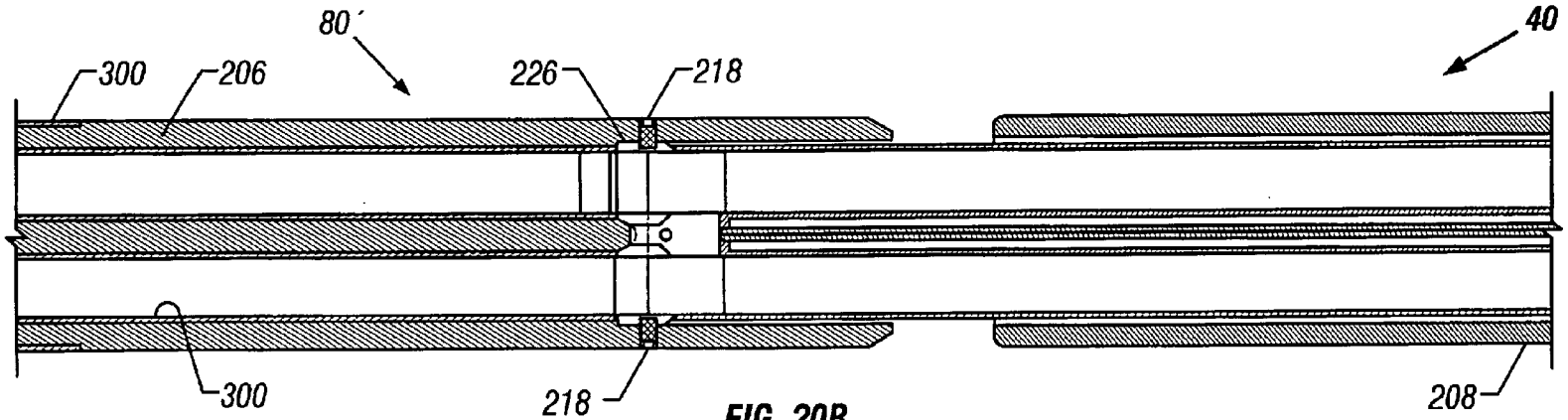
Figure 20C:
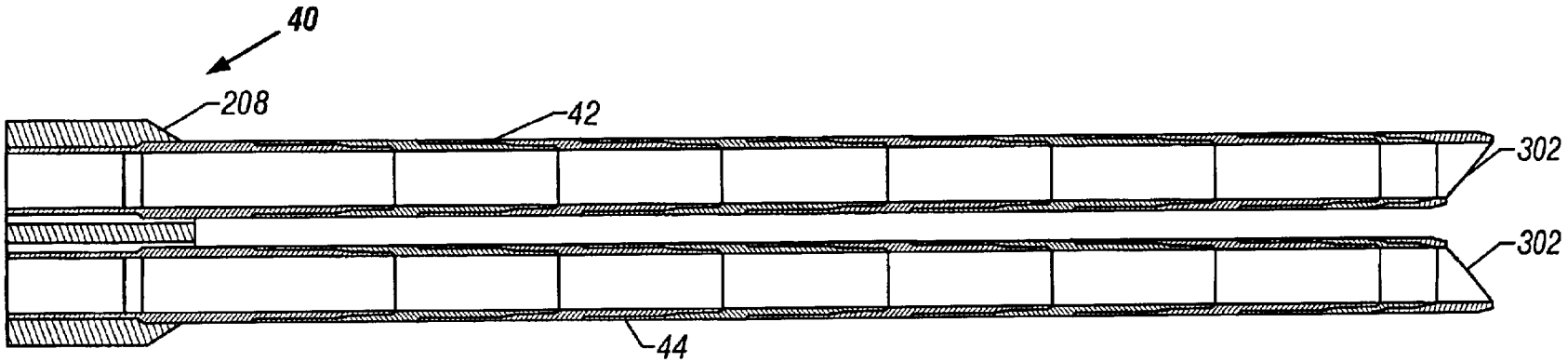

Body 80' further includes two passages 300 (FIG. 20B) therethrough. Note that the longitudinal sectional view of FIGS. 20A–20C is taken along a plane perpendicular to that of the longitudinal sectional view of FIGS. 16A–16C. Dual production tubing strings 52, 54 may be passed through the passages 300. The production tubing strings 52, 54 are attached to the first and second tubing strings 42, 44. In the embodiment shown in FIGS. 20A–20C, the production tubing strings 52, 54 are attached to the first and second tubing strings 42, 44 within the passages 300.

Figure 16A:
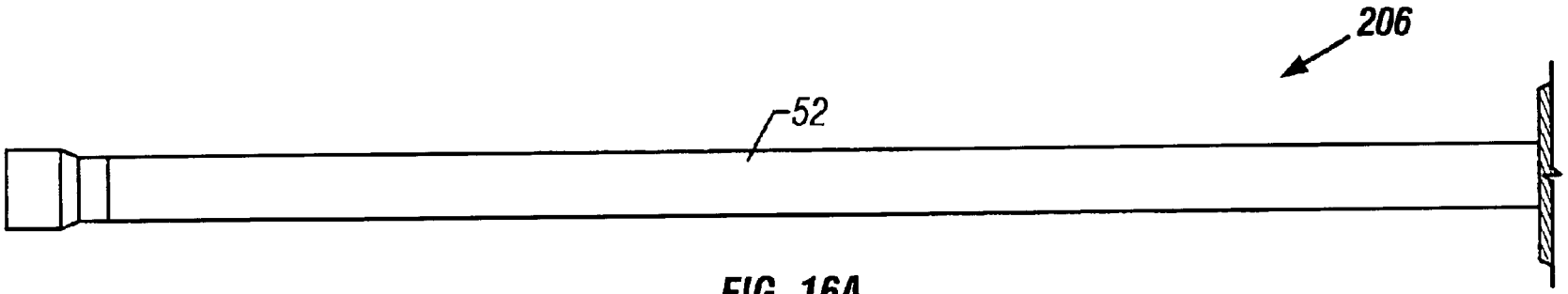
Figure 16B:
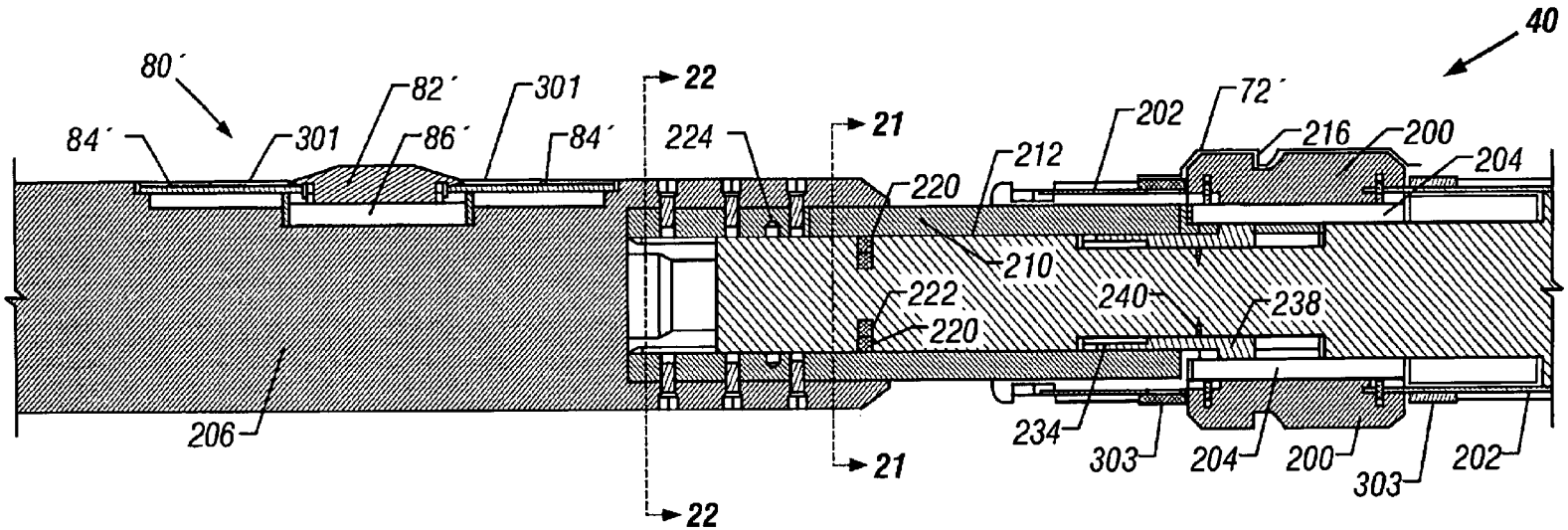
Figure 16C:
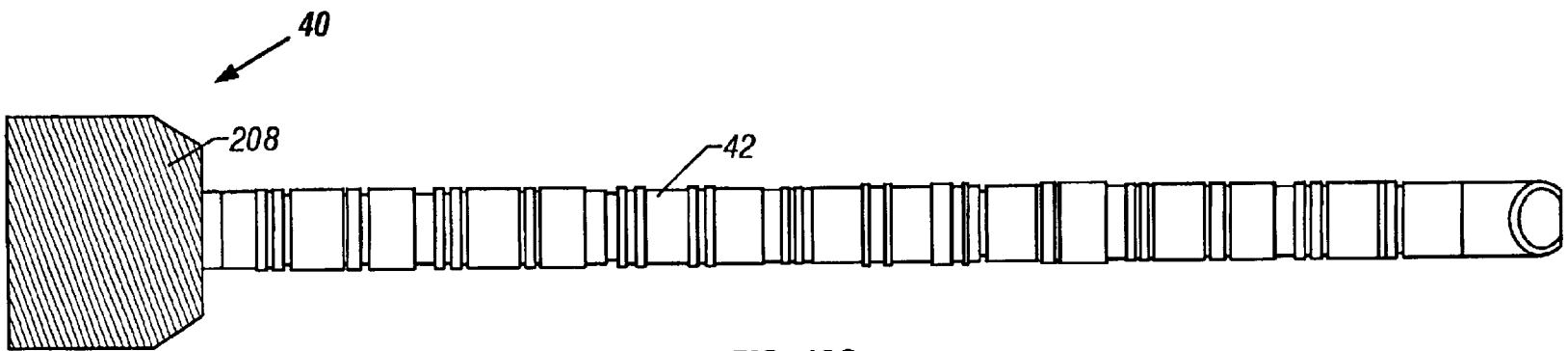

FIGS. 16A–C show the landing tool 40 in its run or deployment position. In this position, the fingers 210 are not abutting the locking elements 200 and are instead located above the locking elements 200 within their respective slots 212. The first body part 206 and the second body part 208 are attached to each other in this configuration by way of shear pins, such as first shear pins 214 shown in FIG. 21. As the landing tool 40 is run downhole, the orienting key 82' interacts with a matching orienting slot (not shown but similar to orienting slot 70) to orient the landing tool 40 within the casing 20 or casing junction 28, as previously discussed. As the orienting key 82' comes to its final position in the orienting slot, each locking element 200 becomes longitudinally and radially aligned with a matching locking slot 72' (similar to locking slot 72, albeit different in shape) and the springs 202 bias the locking elements 200 into the locking slots 72'. The locking slots 72' and locking elements 200 include mating straight surfaces 216 that prevent further downward movement of the landing tool 40. At this point, the landing tool 40 is landed within the locking slots 72' and is appropriately oriented.

Figure 17A:
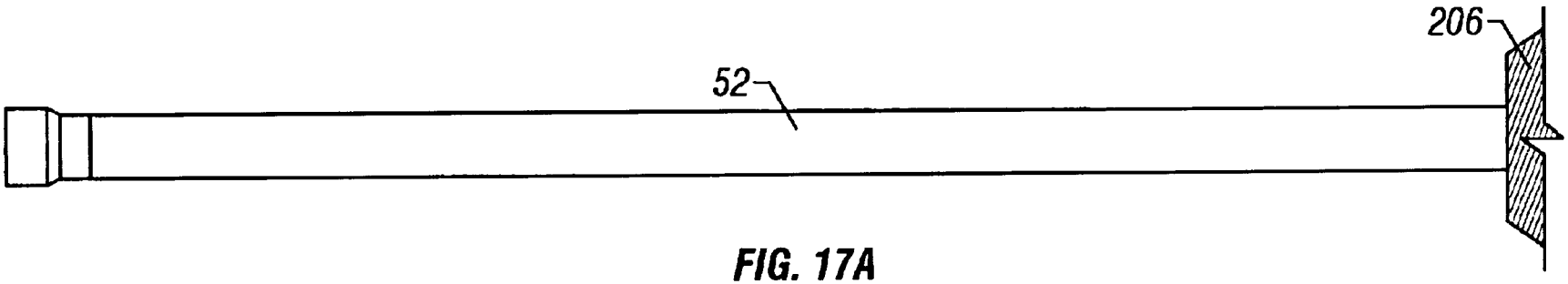
Figure 18A:
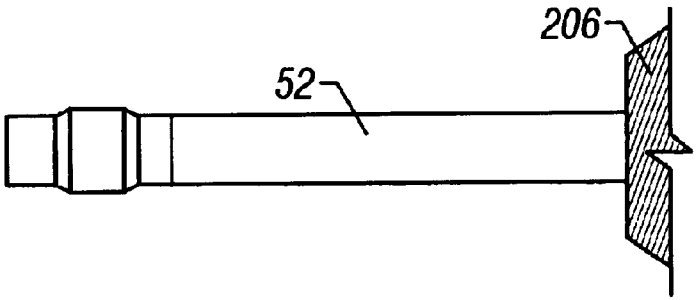
Figure 17B:
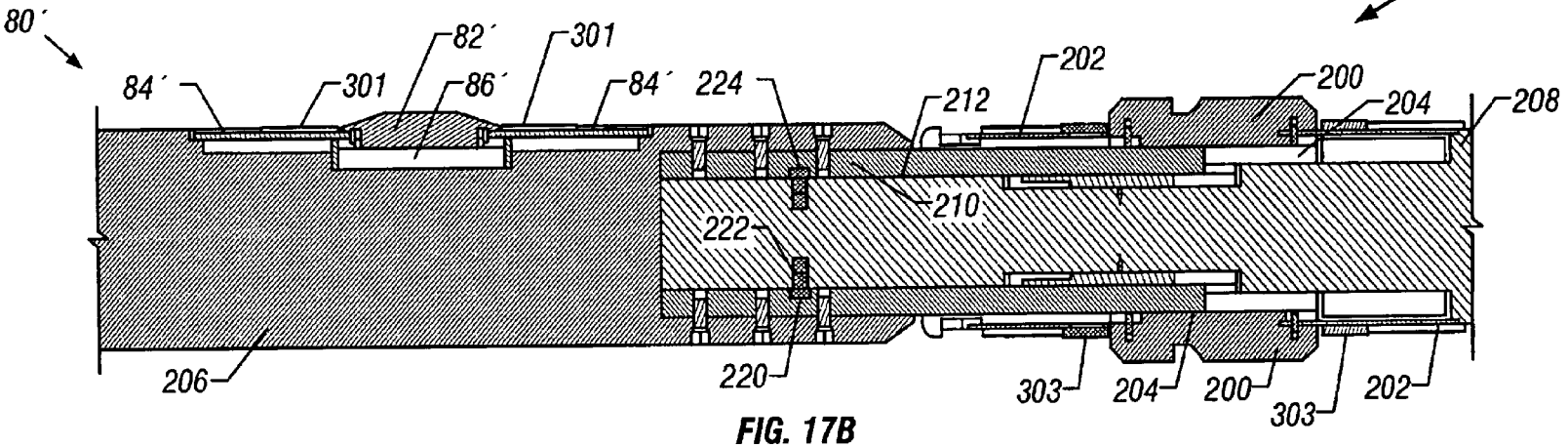
Figure 18B:
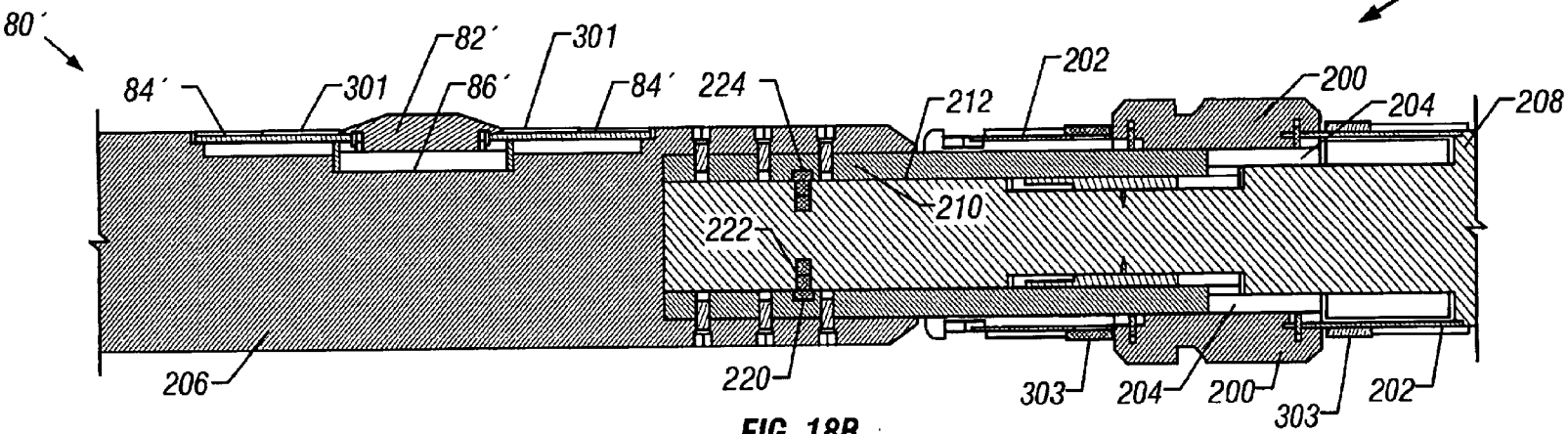
Figure 17C:
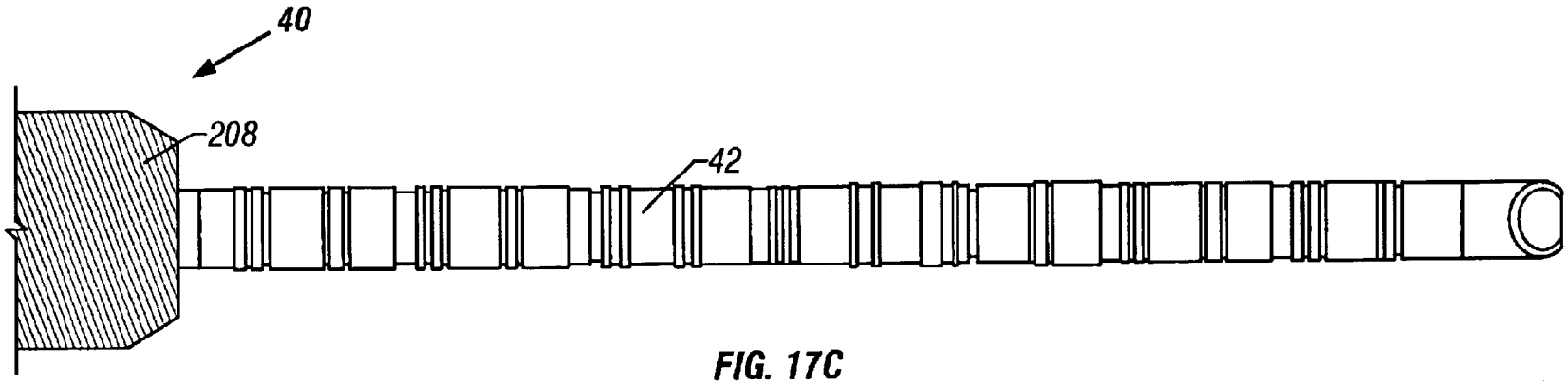
Figure 18C:
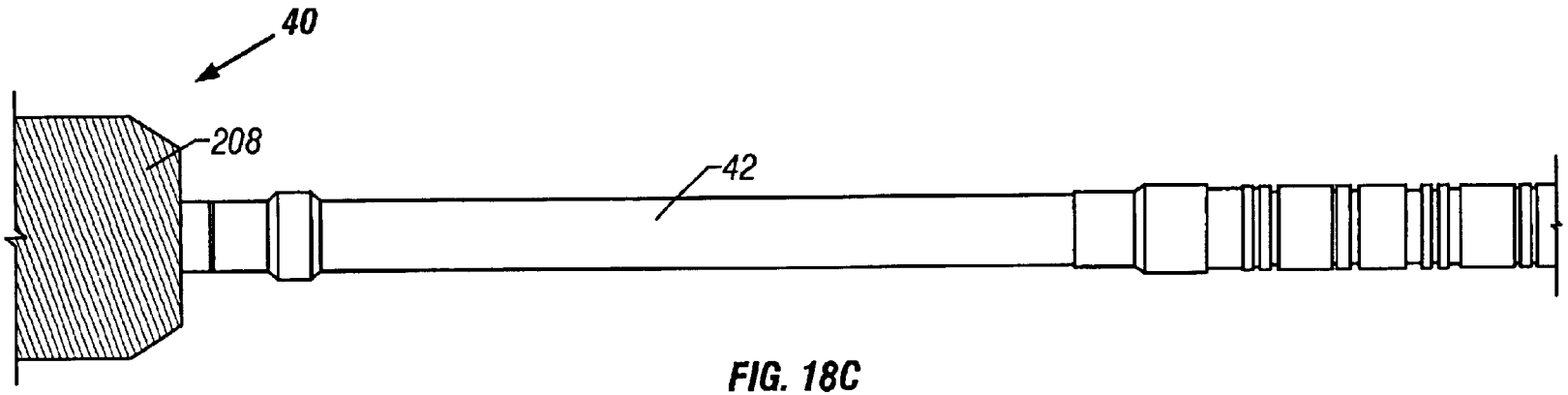
Figure 18D:
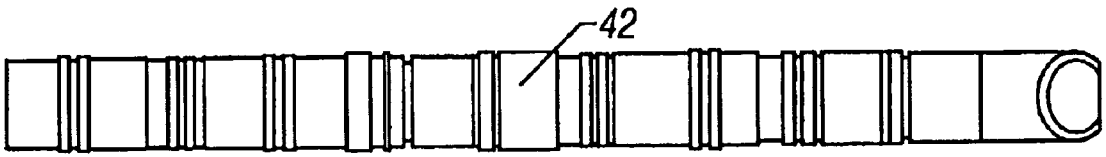

FIGS. 17A–17C show the landing tool 40 locked in position to prevent inadvertent longitudinal motion. To lock the landing tool 40 in place, a downward force is exerted on the landing tool 40 by way of dual production tubing strings 52, 54, for example. If high enough, the downward force acts to shear the first shear pins 214 and allows the downward motion of the first body part 206 in relation to the second body part 208. It is noted that the second body part 208 remains stationary due to its engagement with the locking slots 72' by way of locking elements 200. As the first body part 206 slides, the fingers 210 become wedged next to the locking elements 200, thereby preventing any radial inward movement of the locking elements 200 and thus effectively locking the second body part 208 in place. In addition, once the first body part 206 slides a sufficient distance, openings 222 on the second body part 208 become aligned with openings 224 on the fingers 210 to allow locking pins 220 that are spring loaded within the openings 222 to be biased partially into the openings 224. Once the locking pins 220 are located within the openings 222, 224, the locking pins 220 lock the first and second body parts 206, 208 together.

FIGS. 18A–D show the landing tool 40 with the first and second tubing strings 42, 44 extended in the direction of the first and second lateral wellbores. For purposes of clarity, the landing tool 40 of this embodiment is shown without placement in a main wellbore including lateral wellbores. To extend the first and second tubing strings 42, 44, a downward force is exerted on the landing tool 40 by way of the dual production tubing strings 52, 54, for example. If high enough, the downward force acts to shear a set of second shear pins 218 (see FIGS. 20B and 22) that attach the first and second tubing strings 42, 44 (or the dual production tubing strings 52, 54) to the body 80' (and more particularly to the first body part 206). Once the second shear pins 218 are sheared, the first and second tubing strings 42, 44 can be extended within/through passages 300 and out of landing tool 40. As previously discussed, the first and second tubing strings 42, 44 are then guided in the direction of the first and second lateral wellbores by the diverter 68.

As best seen in FIG. 20C, the lower end of each of the first and second tubing strings 42, 44 may include an inclined surface 302. The inclined surface 302 cooperates with the diverter 68 to more easily facilitate the extension and diversion of the first and second tubing strings 42, 44 into the first and second legs 15, 17.

Figure 19A:
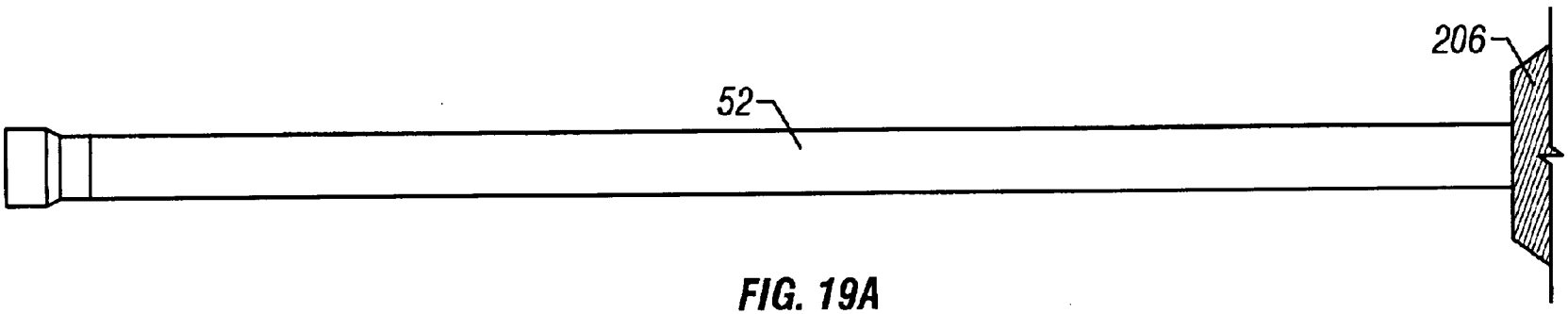
Figure 19B:
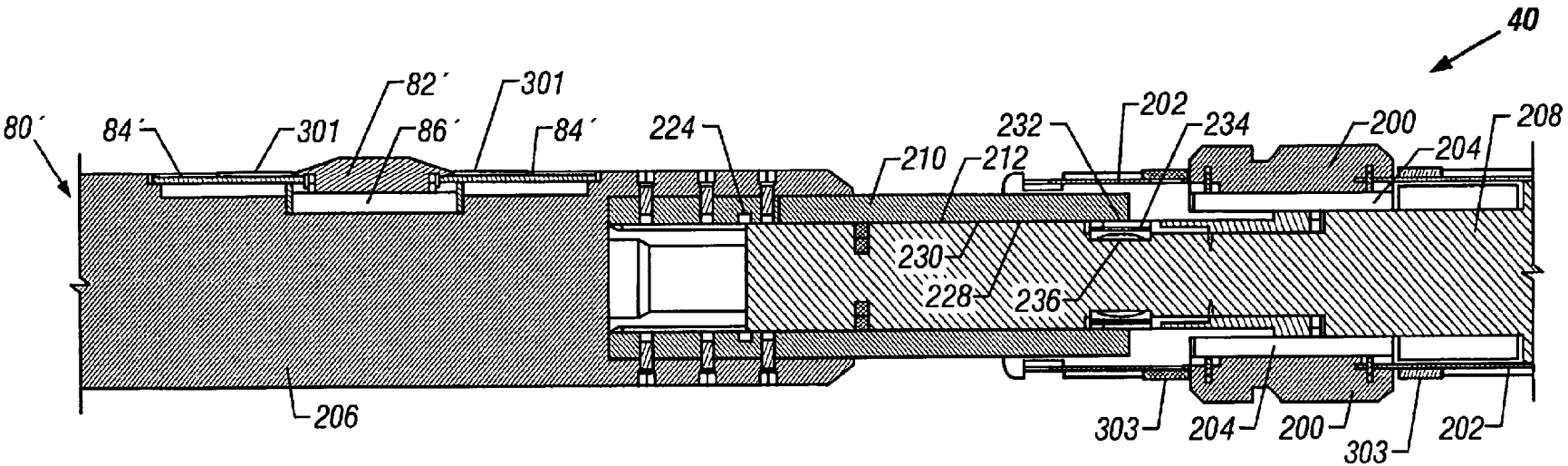
Figure 19C:
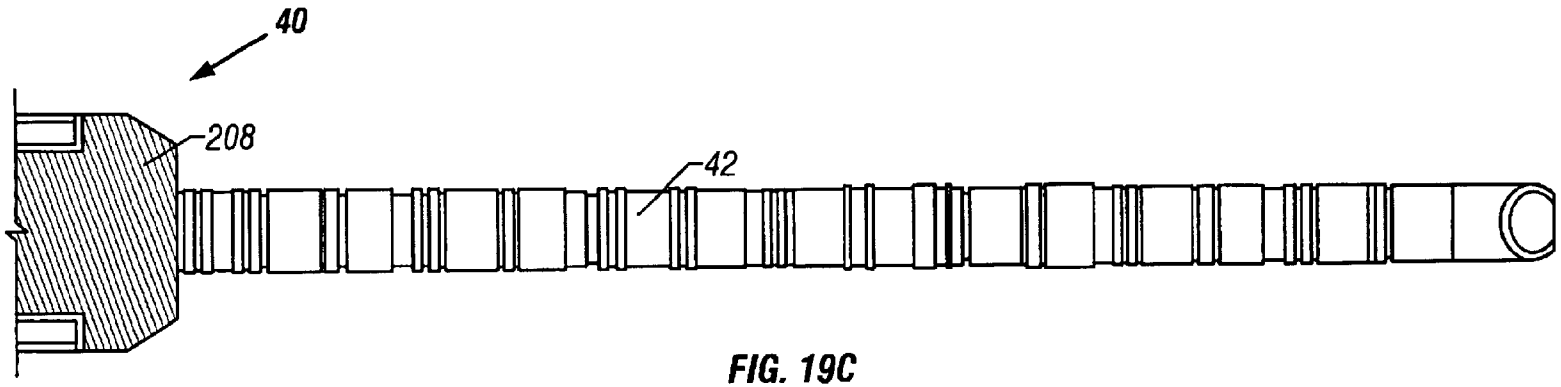
Figure 21:
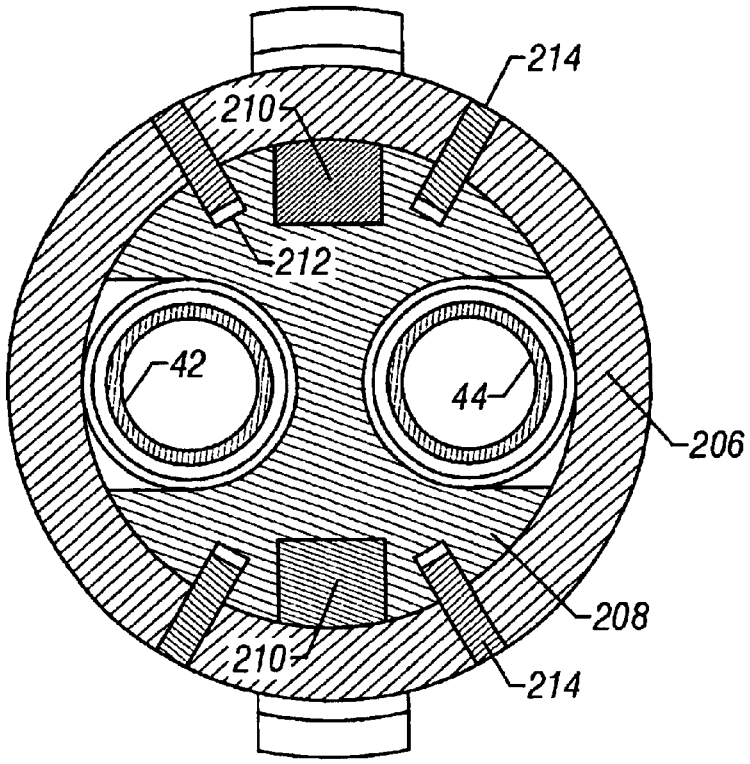
Figure 22:
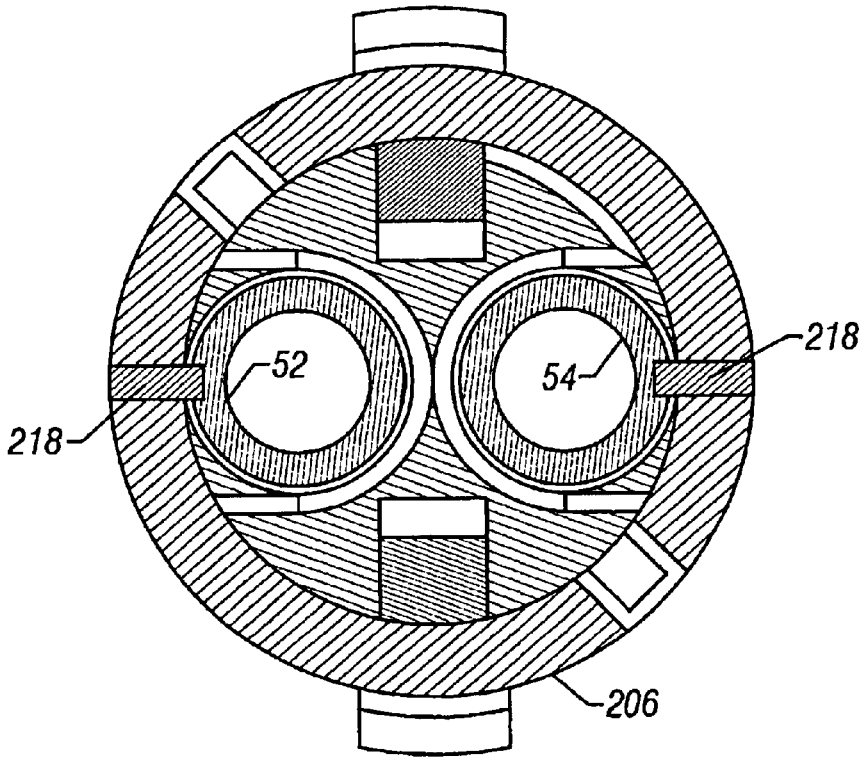

FIGS. 19A–19C show the landing tool 40 in its unset and retrieval position. Once the operator is ready to retrieve the landing tool 40, an upward force is exerted on the landing tool 40 by way of the dual production tubing strings 52, 54, for example. If high enough, the upward force acts to shear the locking pins 220 (compare FIGS. 18B and 19B) that attach the first and second body parts 206, 208. Once the locking pins 220 are sheared, continued upward force on the dual production tubing strings 52, 54 acts to pick up first body part 206 by way of internal shoulder 226 (FIG. 20B). As the first body part 206 slides in relation to the second body part 208 (which is still locked in place), the fingers 210 slide out of abutment with the locking elements 200, thereby allowing the locking elements 200 to be biased radially both inwardly and outwardly.

Figure 24:
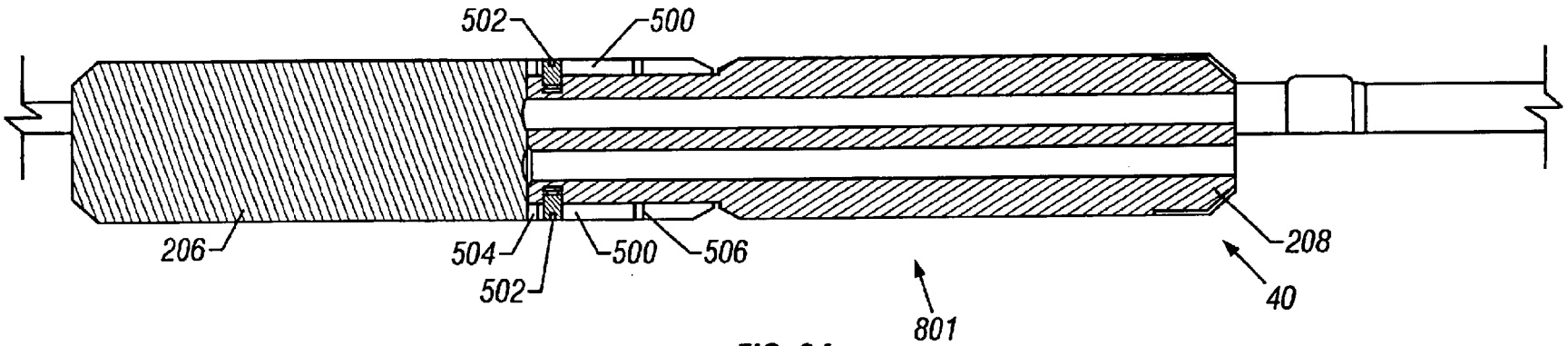
FIGS. 24–25 show another longitudinal section view of the landing tool illustrated in FIGS. 16–22.
Figure 25:
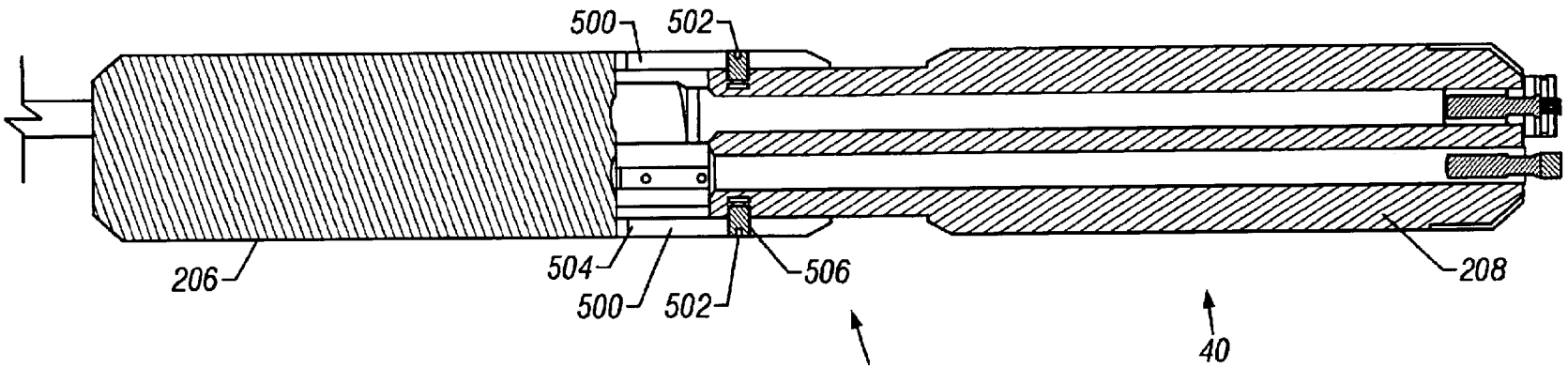

As the first body part 206 continues to be pulled upward, the first body part 206 eventually picks up and supports the second body part 208. FIGS. 24 and 25 show a longitudinal cross-sectional view of the landing tool 40 shown in FIGS. 16–22 taken along a different phase of the body 80'. FIG. 24 shows the tool 40 in the deployment position, and FIG. 25 shows the tool 40 in the retrieval configurations. As can be seen in the Figures, first body part 206 includes at least one radial slot 510 therein, and second body part 208 includes a pin 502 slidingly disposed within each slot 510. Each pin 502 is securely attached to the second body part 208. When the landing tool 40 is in the deployment position (FIG. 24), the pin 502 is proximate the upper end 504 of the slot 510. As the first body part 206 is pulled up during retrieval (FIG. 25), the lower end 506 of the slot 510 eventually abuts and picks up its corresponding pin 502, thereby also picking up the second body part 208.

With the slots and pins 510, 502 providing a secure connection between the first and second body parts 206, 208, continued upward movement of the first body part 206 retrieves the second body part 208 and the first and second tubing strings 42, 44 from the wellbore. Due to the mating angles of the locking element 200 and locking slots 72' and because the locking element 200 can now be biased within second recess 204, the connection between the locking elements 200 and the locking slots 72' does not prevent upward movement of the landing tool 40.

In addition, the upward movement of the first body part 206 (during the initial retrieval process) results in the mating of a teeth profile 228 (FIG. 19B) located on an inner surface 230 of each finger 210 with a teeth profile 232 located on ratchet keys 234. The ratchet keys 234 are located within grooves 236 on second body part 208 and are biased outwardly by springs 236, for instance. The mating teeth profiles 228, 232 are designed so that they do not allow relative motion in the downward direction, but allow relative motion in the upward direction. This is desirable so that, if the landing tool 40 becomes stuck in the wellbore as it is being retrieved, an operator may push and/or pull on the relevant retrieving tool/string without fear of inadvertently locking the locking elements 200 and the landing tool 40 within the wellbore once again. In this manner, regardless of the direction of the jarring force exerted by the operator, the mating teeth 228, 232 prevent the fingers 210 from sliding downwardly and wedging against the locking elements 200 (and thereby locking the locking elements 200).

It is noted that in the run-in position (FIG. 16B), the ratchet keys 234 are covered by a sleeve 238, which is secured to the second body part 208 by way of a set of shear pins 240. As the fingers 210 slide down to lock the landing tool 40 in place (FIG. 17B), the fingers 210 push the sleeve 238 downwardly, shearing the shear pins 240, and uncovering the ratchet keys 234.

It is noted that the shear pins used in the landing tool 40 should be rated to enable the sequence previously described. Thus, for instance, the first set of shear pins 214 are rated lower than the second set of shear pins 218.

The discussion and illustrations within this application refer to a vertical main wellbore that has casing cemented in place. The present invention can also be utilized to complete wells that are not cased entirely and likewise to wells that contain main wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction, operation, materials of construction or design herein shown, other than as described in the claims below. It is therefore evident that the particular embodiments disclosed above may be altered or modified and all such variations are considered within the scope and spirit of the invention.

What is claimed is:

1. A downhole assembly comprising:

a casing junction assembly adapted to be installed at a junction of plural wellbores, the casing junction assembly defining plural outlets to respective plural wellbores, and the casing junction assembly having an integrated diverter providing plural guide surfaces; and a tool engageable in the casing junction assembly and having conduits extendable between a retracted state and an extended state, the guide surfaces of the diverter adapted to guide the conduits into respective outlets, wherein the tool has a setting element to lock the tool in position, wherein the tool is actuatable from the retracted state to the extended state after the tool has been locked in position.

2. The downhole assembly of claim 1, wherein the conduits comprise tubings.

3. The downhole assembly of claim 1, wherein the conduits are in the retracted position for run-in of the tool, and the conduits are adapted to be actuated to the extended position to extend into the outlets.

4. The downhole assembly of claim 1, further comprising packers, each packer comprising a longitudinal bore, the packers adapted to receive the conduits.

5. The downhole assembly of claim 4, wherein the conduits comprise seal assemblies and the packers comprise receptacles, the seal assemblies adapted to engage the receptacles to form sealed connections between the conduits and respective longitudinal bores of the packers.

6. The downhole assembly of claim 1, further comprising a first orienting element, wherein the tool comprises a second orienting element adapted to interact with the first orienting element to orient the conduits with respect to the outlets.

7. The downhole assembly of claim 6, further comprising a casing string attached to the casing junction assembly, wherein the first orienting profile is integrally formed in the casing string.

8. The downhole assembly of claim 6, wherein the casing junction assembly has an inlet, the first orienting element being integrally formed in the inlet.

9. The downhole assembly of claim 6, wherein the casing string and casing junction assembly are adapted to be cemented in the wellbore.

10. The downhole assembly of claim 1, wherein the casing junction assembly is adapted to be cemented in the wellbore.

11. The downhole assembly of claim 1, wherein the diverter has a base and an apex, and the guide surfaces extend radially from a longitudinal center of the diverter, and the guide surfaces project further from the longitudinal center at the diverter base than at the diverter apex.

12. The downhole assembly of claim 11, wherein the guide surfaces are sloped.

13. The downhole assembly of claim 1, wherein the conduits are adapted to be separated to guide into respective outlets.

14. The downhole assembly of claim 1, wherein the conduits are extended in response to a downward force applied on the tool.

15. The downhole assembly of claim 1, wherein the casing junction assembly has a landing profile to receive the setting element.

16. A downhole assembly comprising:

a casing junction assembly adapted to be installed at a junction of plural wellbores, the casing junction assembly defining plural outlets to respective plural lateral wellbores, the casing junction assembly having an integrated diverter providing plural guide surfaces proximate corresponding outlets;

a tool having plural conduits extendable into the plural outlets, the guide surfaces of the diverter adapted to guide respective conduits into respective outlets;

a first orienting element, wherein the tool comprises a second orienting element adapted to interact with the first orienting element to orient the conduits with respect to the outlets; and a landing profile tool having a locking element engaged in the landing profile.

17. A method of completing a well at a junction of plural wellbores, comprising:

providing a casing junction assembly having plural outlets for establishing communication with respective plural wellbores;

providing a diverter integrated with the casing junction assembly, the diverter having plural guide surfaces;

engaging a tool having plural conduits with the casing junction assembly;

actuating the tool from a retracted state to an extended state to extend the conduits into the outlets;

guiding the conduits into respective outlets with the plural guide surfaces; and actuating a setting element of the tool to lock the tool in position, wherein actuating the tool from the retracted state to the extended state is performed after locking the tool in position.

18. The method of claim 17, further comprising separating the conduits to guide them into the outlets.

19. The method of claim 17, further comprising providing packers have seal bore receptacles to receive the respective conduits.

20. The method of claim 17, further comprising engaging a first orienting element with a second orienting element proximate the junction to align the conduits with the outlets.

21. The method of claim 20, further comprising engaging a locking element of the tool with a locking slot at the junction.

22. The method of claim 17, further comprising:

attaching the casing junction assembly to a casing string; and inserting the casing junction assembly and casing into the well.

23. The method of claim 22, further comprising cementing the casing string and the casing junction assembly in the wellbore.

24. The method of claim 17, wherein actuating the tool to the extended state is performed in response to a downward force on the tool.

25. The method of claim 17, wherein actuating the setting element comprises actuating the setting element to engage a landing profile in the casing junction assembly.

26. A downhole assembly comprising:

a casing junction assembly adapted to be installed at a junction of plural wellbores, the casing junction assembly defining plural outlets to respective plural wellbores, and the casing junction assembly having an integrated diverter providing plural guide surfaces;

a tool engageable in the casing junction assembly and having conduits extendable between a retracted state and an extended state, the guide surfaces of the diverter adapted to guide the conduits into respective outlets, wherein the conduits are adapted to be separated to guide into respective outlets; and a strap to connect the conduits, the strap adapted to be broken to enable separation of the conduits.

27. The downhole assembly of claim 26, wherein the conduits are biased away from each other when not connected.

28. A downhole assembly comprising:

a casing junction assembly adapted to be installed at a junction of plural wellbores, the casing junction assembly defining plural outlets to respective plural wellbores, and the casing junction assembly having an integrated diverter providing plural guide surfaces;

a tool engageable in the casing junction assembly and having conduits extendable between a retracted state and an extended state, the guide surfaces of the diverter adapted to guide the conduits into respective outlets; and wherein the conduits are adapted to be separated to guide into respective outlets, a pin to connect the conduits, the pin adapted to be broken to enable separation of the conduits.

29. The downhole assembly of claim 28, wherein the conduits are biased away from each other when not connected.

30. A method of completing a well at a junction of plural wellbores, comprising:

providing a casing junction assembly having plural outlets for establishing communication with respective plural wellbores;

providing a diverter integrated with the casing junction assembly, the diverter having plural guide surfaces;

engaging a tool having plural conduits with the casing junction assembly;

actuating the tool from a retracted state to an extended state to extend the conduits into the outlets;

guiding the conduits into respective outlets with the plural guide surfaces; and connecting the conduits by one of a strap and pin.

31. The method of claim 30, further comprising breaking the one of the strap and pin to separate the conduits.

* * * * *